US006946807B2

(12) United States Patent
Okamoto et al.

(10) Patent No.: US 6,946,807 B2
(45) Date of Patent: Sep. 20, 2005

(54) LAMP LIGHTING APPARATUS FOR A DISCHARGE LAMP

(75) Inventors: Masashi Okamoto, Hyogo (JP); Takanori Samejima, Hyogo (JP); Izumi Takaya, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/730,994

(22) Filed: Dec. 10, 2003

(65) Prior Publication Data

US 2004/0119425 A1 Jun. 24, 2004

(30) Foreign Application Priority Data

Dec. 10, 2002 (JP) ..... 2002-357974

(51) Int. Cl.[7] ..... G05F 1/00

(52) U.S. Cl. ..... 315/291; 315/307; 315/209 SC; 315/274

(58) Field of Search ..... 315/291, 307, 315/308, 224, 225, DIG. 4, 274, 209 SC, 276, 279

(56) References Cited

U.S. PATENT DOCUMENTS 6,181,084 B1 1/2001 Lau ..... 315/291

6,437,515 B1 * 8/2002 Kamoi et al. ..... 315/209 R

FOREIGN PATENT DOCUMENTS

| | | |
|---|---|---|
| JP | 2002-233152 A1 | 8/2002 |
| WO | WO00/16594 | 3/2000 |

* cited by examiner

*Primary Examiner*—Tuyet Thi Vo
(74) *Attorney, Agent, or Firm*—Rader, Fishman & Grauer PLLC

(57) ABSTRACT

A lamp lighting apparatus has a discharge drive circuit for supplying discharge current to the lamp, a voltage conversion circuit for boosting voltage from DC power and supplying the boosted voltage to the discharge drive circuit, and an arc discharge detecting circuit for detecting that a state of discharge of the lamp changes to arc discharge, and outputting an arc discharge transition signal to the voltage conversion circuit, wherein when the voltage conversion circuit receives the arc discharge transition signal which shows that the transition to the arc discharge does not take place, the voltage conversion circuit supplies a first voltage or higher to the discharge drive circuit, and when the voltage conversion circuit receives the arc discharge transition signal which shows that the transition to the arc discharge takes place, the voltage conversion circuit supplies a second voltage lower than the first voltage to the discharge drive circuit.

6 Claims, 13 Drawing Sheets

FIG. 12A
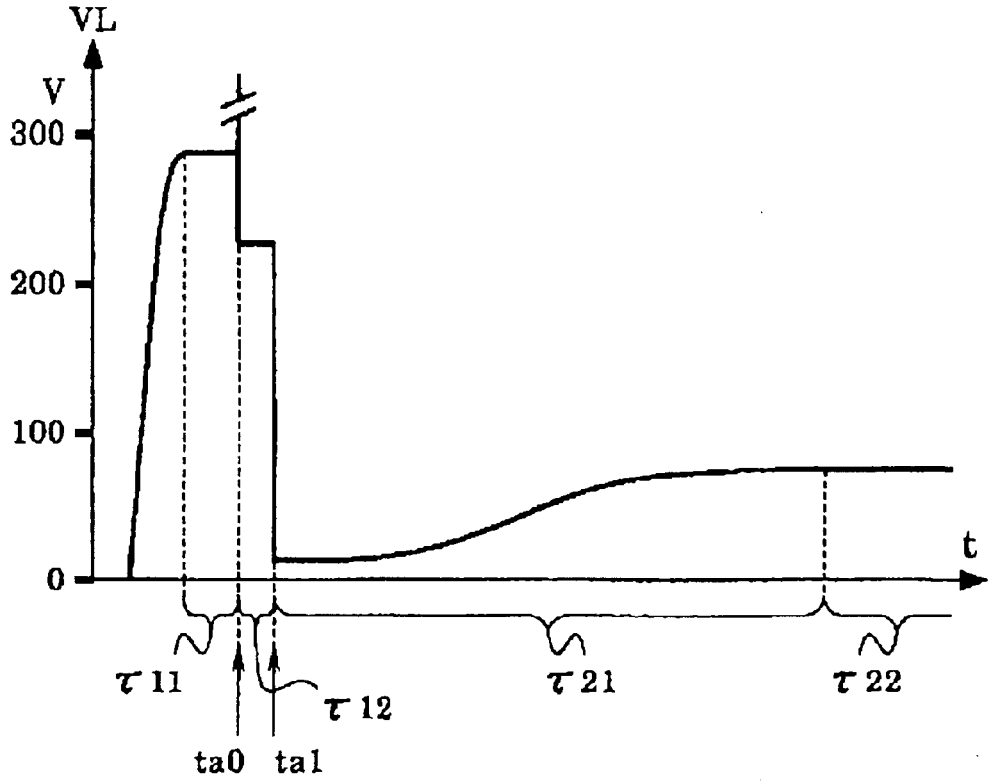
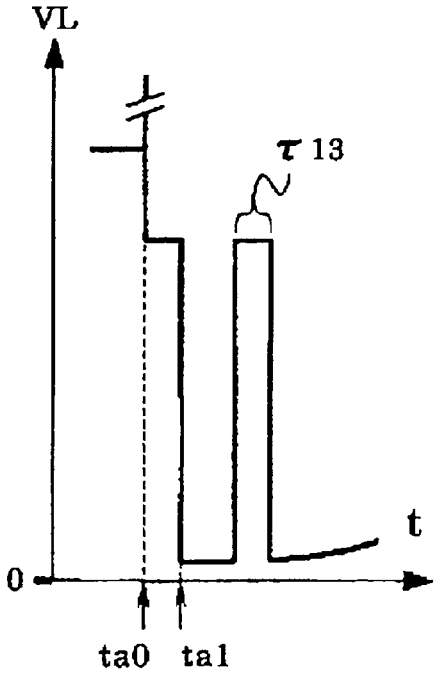
FIG. 12B
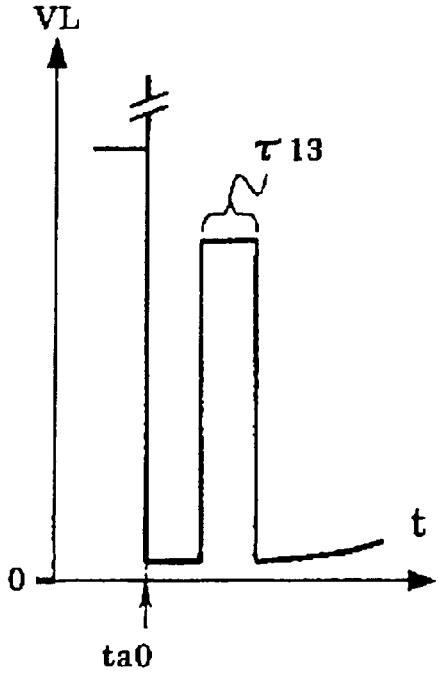
FIG. 12C

LAMP LIGHTING APPARATUS FOR A DISCHARGE LAMP

TECHNICAL FIELD OF THE INVENTION

The present invention relates to a lamp lighting apparatus for lighting a discharge lamp such as a high intensity discharge lamp (an HID lamp) including a metal vapor discharge lamp such as a high pressure mercury discharge lamp and a metal halide lamp, which is used as a light source of an optical apparatus such as a projector.

DESCRIPTION OF RELATED ART

In an optical apparatus such as a liquid crystal projector, a DLP™ (TEXAS INSTRUMENTS, INC.) projector and so on, the high intensity discharge lamp is used.

Changes of lamp voltage (VL) in a period from an initiation of discharge to completion of transition to arc discharge will be described below referring to FIG. 12A in which the changes of the lamp voltage is conceptually shown.

In order to light this kind of discharge lamp (Ld), with a cathode (E1) and an anode (E2) of the lamp to which voltage called unloaded open circuit voltage is applied, high voltage is applied to a discharge space so that dielectric break down occurs thereby initiating discharge. After that, the state of the discharge changes to arc discharge from glow discharge. In the figure, the unloaded open circuit voltage is impressed in a period (τ11) and then at a point (ta0), high voltage is applied.

In case that the discharge lamp (Ld) is a typical high pressure mercury discharge lamp including mercury (more than 0.15 mg/mm$^3$ in the discharge space), when 250 to 350 V is applied as the unloaded open circuit voltage, the lamp voltage in a typical glow discharge is more than about 170 V and less than the unloaded open circuit voltage.

Although, at a point (ta1) after the glow discharge period (τ12), the discharge state changes to arc discharge, the lamp voltage after the transition to the arc discharge is 8 V to 15 V. After that, as temperature of the lamp rises by power supply from the lamp lighting apparatus, the lamp voltage gradually rises. Finally, the discharge reaches to a stationary arc discharge state. The lamp voltage in the stationary arc discharge state typically is 55 to 140 V.

Although after the transition to the arc discharge, the lamp voltage is within the about 8 to 140 V range as described above, the lamp lighting apparatus needs to have ability to generate high voltage in order to maintain the unloaded open circuit discharge voltage at starting or the glow discharge voltage.

In FIG. 13, an example of the conventional light source apparatus is shown.

In the figure, a first level power supply (Ur) comprises a commercial power supply (As), a diode bridge (a rectifier) (Hr) and condenser (Cr) provided if necessary. Voltage from the commercial power supply (As) is rectified by the diode bridge (Hr) and smoothed or filtered by the condenser provided if necessary.

Output voltage from the first level power supply (Ur) is 140 V in case of an AC 100 V area or 280 V in case of an AC 200 V area. Since the voltage fluctuate largely, and further, the output voltage is not sufficient for the lamp lighting apparatus to generate the unloaded open circuit voltage. Therefore, a booster circuit (Ub') is connected to the output of the first level power supply (Ur) thereby forming a DC power supply (Em') for supplying power to the lamp lighting apparatus.

In the figure, an example of the booster circuit (Ub'), a boost chopper is shown. The boost chopper comprises a boost controlling circuit (Fb'), a gate drive circuit (Gb'), a switch element (Qb'), a coil (Lb'), a diode (Db'), and a smoothing condenser (Cb'), thereby outputting, from the DC power supply (Em'), approximately constant voltage such as about 370 V which is higher than the voltage of the first level power supply (Ur).

The output of the DC power supply (Em') is supplied to a lamp lighting apparatus (Ex').

In the figure, as an example of the lamp lighting apparatus (Ex'), a step-down chopper is shown. The step-down chopper comprises a lighting controlling circuit (Fx'), a gate drive circuit (Gx'), a switch element (Qx'), a coil (Lx'), a diode (Dx') and a smoothing condenser (Cx'). As the lighting controlling circuit (Fx') measures lamp voltage (LV) and lamp current (IL) by a measuring device (not shown), in a feed-back manner, the lighting controlling circuit (Fx') impresses the unloaded open circuit voltage described above, maintains the glow discharge, and controls lamp current and lamp power in the arc discharge period.

In order to superpose high voltage over the unloaded open circuit voltage, a starter (Ui) comprising a transformer (Ki) is connected to the lighting controlling circuit (Fx').

Since the lamp lighting apparatus (Ex') comprises a step-down chopper, in a range of the input voltage, that is, voltage lower than the output voltage of the DC power supply (Em'), it is possible to arbitrarily set lamp voltage. Thus, it is possible to output high voltage such as the unloaded open circuit voltage or glow discharge voltage, or low lamp voltage such as that in the arc discharge thereby fulfilling its functions necessary for lighting the discharge lamp (Ld).

The booster circuit (Ub') is controlled to work as an active filter, wherein current flowing from the commercial power supply (As) is controlled so that the amount of each harmonic component to voltage frequency is less than a certain value, thereby functioning a power factor controller (PFC).

Thus, the light source apparatus shown in FIG. 13 has all necessary functions. However, despite the fact that only low voltage is necessary for the arc discharge after the lighting status of the discharge lamp (Ld) changes to the arc discharge, the DC power supply (Em') continues to supply high unloaded open circuit voltage or high voltage capable of generating glow discharge, to the lamp lighting apparatus (Ex').

In general, the boost chopper has characteristic that the greater the boost ratio, that is, the ratio of output voltage to input ratio, the larger the switching loss. The step-down chopper has characteristic that the greater the voltage step-down ratio, that is, the ratio of input voltage to output voltage, the larger the switching loss.

Therefore, in the conventional light source apparatus, the DC power supply (EM') produces unnecessary power loss since the power supply (Em') boosts voltage higher than that the lamp lighting apparatus (Ex') needs. Further, the lamp lighting apparatus (Ex') produces unnecessary power loss since the lamp lighting apparatus (Ex') is supplied higher voltage than that the discharge lamp (Ld) needs. Therefore, it is necessary to largely step-down the voltage to lower lamp voltage.

Therefore, a temperature rise of the switching elements (Qb') and (Qx') which are part of the DC power supply (Em')

and the lamp lighting apparatus (Ex') respectively is large. Therefore, it is necessary to use a large size radiator or a cooling fan capable of generating much airflow. Thus, it leads to growth in size and in weight and increases noises of the optical apparatus. Further, it is not economical and there are impacts on the environment.

Refer to Japanese Laid Open Patent Nos. TOKKAI2002-233152 and TOKUHYO2002-525809 for the related art.

SUMMARY OF THE INVENTION

It is an object of the present invention to provide a lamp lighting apparatus capable of solving the problem, in the conventional technology, that the unnecessary power loss is produced since even after the status of the discharge changes to arc discharge, the discharge lamp (Ld) is supplied higher voltage than that necessary for the discharge lamp (Ld), by the DC power supply (Em').

According to the present invention, a lamp lighting apparatus for lighting a discharge lamp in which discharge medium is encupsalated and a pair of electrodes are provided, the lamp lighting apparatus comprises a discharge drive circuit for supplying discharge current to the discharge lamp, a voltage conversion circuit for boosting voltage from a DC power and supplying the boosted voltage to the discharge drive circuit, and an arc discharge detecting circuit for detecting that a state of discharge of the discharge lamp changes to arc discharge, and outputting an arc discharge transition signal to the voltage conversion circuit, wherein when the voltage conversion circuit receives the arc discharge transition signal which shows that the transition to the arc discharge does not take place, the voltage conversion circuit supplies a first voltage or higher to the discharge drive circuit, and when the voltage conversion circuit receives the arc discharge transition signal which shows that the transition to the arc discharge takes place, the voltage conversion circuit supplies a second voltage lower than the first voltage to the discharge drive circuit.

In the lamp lighting apparatus, the voltage conversion circuit may comprise a boost chopper, and when the voltage conversion circuit receives the arc discharge transition signal which shows that a state of the discharge changes to the arc discharge, an operation of the voltage conversion circuit may be suspended.

The lamp lighting apparatus further may comprise a starter for initiating the discharge lamp, wherein a predetermined maximum continuing time for repeat trials of discharge initiation may be set, and after an arc discharge transition waiting period beginning from an initiation of an operation of the starter expires, the discharge drive circuit may recognize that it is detected that the state of the discharge changes to the arc discharge.

Further, in the lamp lighting apparatus, the arc discharge transition waiting period may be determined by adding the a maximum continuing time and a maximum necessary time required from an initiation of the discharge of the discharge lamp to a completion of the transition of the arc discharge.

Description of an operation of a lamp lighting apparatus according to the present invention will be given below.

FIG. 1 is a block diagram showing a lamp lighting apparatus (Ex). Power from a DC power supply (Em) is supplied to the voltage conversion circuit (Ub). Power from a voltage conversion circuit (Ub) is supplied to a discharge drive circuit (Ux).

As described above, before the discharge drive circuit (Ux) lights the discharge lamp (Ld), unloaded open circuit voltage is applied to the discharge lamp (Ld). Before the unloaded open circuit voltage is applied to the discharge lamp (Ld), an arc discharge detecting circuit (Ua) sends an arc discharge transition signal or signals (Sa) as negating logic to the voltage conversion circuit (Ub). When the voltage conversion circuit (Ub) receives the negating logic arc discharge transition signal (Sa), it converts voltage from the DC power supply (Em) to at least a predetermined first voltage (Vt1) to apply to the discharge drive circuit (Ux). The first voltage (Vt1) is selected so that the discharge drive circuit (Ux) can output the unloaded open circuit voltage.

The discharge drive circuit (Ux) supplies the unloaded open circuit voltage to the discharge lamp (Ld), and initiates a starter (Ui) so as to superimpose a high voltage pulse on the unloaded open circuit voltage. When the high voltage pulse is applied to the discharge lamp (Ld), dielectric breakdown takes place in a discharge space (Zd) so that charged particles are accelerated by the unloaded open circuit voltage applied to both electrodes (E1) and (E2) thereby initiating glow discharge in the discharge lamp (Ld). Since, as described above, the glow discharge takes place at high voltage, during the period (τ12), the voltage conversion circuit (Ub) maintains boosting condition to the first voltage (Vt1).

The electrodes are heated by the glow discharge to temperature at which thermionic emission from the electrodes takes place thereby changing to arc discharge. As described above, since after changing to the arc discharge, the discharge voltage is low, the discharge drive circuit (Ux) controls power supplied to the discharge lamp (Ld) so that lamp current (IL) does not become excessive.

After completion of the transition to the arc discharge, the arc discharge detecting circuit (Ua) sends the arc discharge transition signal (Sa) as asserting logic (truth logic) to the voltage conversion circuit (Ub). When the voltage conversion circuit (Ub) receives the asserting logic arc discharge transition signal (Sa), it converts voltage from the DC power supply (Em) to at least a predetermined second voltage (Vt2) to apply to the discharge drive circuit (Ux). The second voltage (Vt2) is selected so that the discharge drive circuit (Ux) can output the maximum voltage during the period of the steady-state arc discharge.

As described above, after the transition to the arc discharge, the lamp voltage (VL) gradually rises, and the arc discharge state becomes stationary.

According to the present invention, the voltage becomes lower than that at starting and is applied from the voltage conversion circuit (Ub) to the discharge drive circuit (Ux) much time before the discharge of the discharge lamp (Ld) becomes stable. However since the voltage is enough for the discharge drive circuit (Ux) output maximum voltage in the stationary arc discharge state even though the voltage is low, the discharge drive circuit (Ux) can supply the discharge current to the discharge lamp (Ld) without any problems, in the period (τ21) of a process in which the arc discharge voltage rises, and even in the period (τ22) after the arc discharge state is stationary.

The discharge drive circuit (Ux) controls, in a feed-back manner, the impression of the unloaded open circuit voltage as described, preservation of the glow discharge, the lamp current and power of the lamp at the arc discharge period, in accordance with the measured value of the lamp voltage (VL) and the lamp current (IL).

As described above, since in the lamp lighting apparatus (Ex) according to the present invention, the voltage conversion circuit (Ub) generates high voltage to at only the period for maintaining impression of the unloaded open circuit voltage and the glow discharge which need high voltage, temperature rise of these elements of the voltage conversion circuit (Ub) is slight since the period is very short even though the voltage conversion circuit (Ub) may cause relatively large power loss at that period. At a period other than that period, since the voltage conversion circuit (Ub) generates only low voltage and power loss is slight, and the temperature rise of the elements of the voltage conversion circuit (Ub) is slight.

Since the DC power supply (Em') of the conventional light source apparatus generates high voltage from first to last, the power loss is large from first to last. However, in the lamp lighting apparatus (Ex) according to the present invention, since the DC power supply (Em) generates only low voltage from first to last and the boost ratio is small from first to last, the power loss is slight and the temperature rise of the elements of the DC power supply (Em) can be controlled to a low level.

Further, in the conventional lamp lighting apparatus (Ex'), although only low voltage is necessary for the period of the arc discharge which is most part of the lamp lighting sequence period, high voltage is supplied thereby causing the large power loss at the most period. On the other hand, since the voltage conversion circuit (Ub) according to the present invention supplies only low voltage to the discharge drive circuit (Ux) at the arc discharge period which is most part of the lamp lighting sequence period, the step down voltage ratio is small, and therefore the power loss is slight, and further it is possible to control the temperature rise of the elements of the discharge drive circuit (Ux) to a low level from first to last.

In the light source apparatus, in case that the lamp lighting apparatus (Ex) receive power from the DC power supply including the booster circuit (Ub') shown in FIG. 13, as one embodiment, the voltage conversion circuit (Ub) may be formed so as to have function of the booster circuit (Ub'). In this case, the lamp lighting apparatus according to the present invention functions even though the voltage conversion circuit (Ub) may also have function of the power factor controller as described above. Refer to the second embodiment of the present invention.

Description of the arc discharge transition signal (Sa) which is outputted by the arc discharge detecting circuit (Ua) will be given below.

In case that the arc discharge detecting circuit (Ua) determines whether the discharge state of the discharge lamp (Ld) is arc discharge, glow discharge or (non-discharge) unloaded open circuit voltage applied state, it is determined based on whether the lamp voltage (VL) is lower than threshold voltage while appropriate lamp current (IL) is applied.

As described above, since in case that the discharge lamp (Ld) is a typical high pressure mercury discharge lamp including mercury (more than 0.15 mg/mm$^3$ in the discharge space), the lamp voltage in a typical glow discharge is more than 170 V, and the lamp voltage after transition to the arc discharge is 8 V to 15 V. For example, the threshold voltage may be set to 100 V. In this case, when the lamp voltage (VL) is 100 V or lower, it can be determined that the discharge state is arc discharge, and if the lamp voltage (VL) is higher than 100 V, it can be determined that the discharge state is glow discharge or (non-discharge) unloaded open circuit voltage applied state.

It is necessary to use caution with immediate transition from the asserting logic to negating logic (false logic) of the arc discharge transition signal even though it is determined that the discharge state is arc discharge. This is because even thought the discharge state changes to the arc discharge, it can change back to the glow discharge state.

For example, as shown in FIG. 12B, after a time point (ta1) when the discharge state changes from glow discharge to arc discharge, glow discharge may take place for a period (τ13), or as shown in FIG. 12C, after arc discharge may sometimes take place without glow discharge, glow discharge may take place for the period (τ13). More complex process may take place.

Accordingly, when it is determined that the discharge state changes to arc discharge state, based on whether the lamp voltage (VL) is the appropriately determined threshold voltage or less, an appropriate grace period should be provided before changing the arc discharge transition signal (Sa) from the negating logic to the asserting logic. During the grace period, when the lamp voltage (VL) changes back to the threshold voltage, the discharge state should be determined as the state before it is determined that the discharge state changes to the arc discharge.

The reason that the discharge state of the discharge lamp (Ld) changes back to the glow discharge is that when non-gaseous matter such as mercury is attached to the electrodes of discharge lamp (Ld), another arc discharge different from that due to the thermionic discharge mechanism takes place and the non-gaseous discharge matter is evaporated by the discharge and then the discharge state changes back to the glow discharge at a time of depletion of the matter.

The amount of discharge medium encapsulated in the discharge lamp (Ld) is limited to a certain variation. Since in the discharge drive circuit (Ux), the lamp voltage (VL) and the lamp current (IL), that is, power applied right after the transition to the arc discharge is limited to a certain variation, there is maximum limitation to the duration of the arc discharge with changing back to the glow discharge. The maximum limitation of time, that is, the maximum amount of time (τwf) required to complete the transition to the arc discharge from the initiation of the discharge, is determined by actually measuring a plurality of lamp lighting apparatuses.

As described above, the determination as to whether the discharge state of the discharge lamp (Ld) changes to the arc discharge is made based on whether the lamp voltage (VL) is the appropriately determined threshold or less. Further, when the arc discharge transition signal (Sa) is changed from the negating logic to the asserting logic based on this determination, the certain grace period is provided, and after that, the arc discharge transition signal (Sa) is generated. The grace period is set to the maximum time (τwf) so that it is possible to prevent the discharge state from changing back to glow discharge after the arc discharge transition signal (Sa) is changed from negating logic to asserting logic.

Although the maximum time (τwf) depends on the amount of non-gaseous discharge medium encapsulated in the discharge lamp (Ld) and setting of the lamp current (IL) right after the transition to the arc discharge, usually it is about 2 to 4 seconds.

If the return to the glow discharge actually takes place after the arc discharge transition signal (Sa) changes from negate logic to asserting logic, the arc discharge transition signal (Sa) can merely be changed back to the negating logic from the asserting logic. In that case, the voltage conversion circuit (Ub) increases voltage supplied to the discharge drive circuit (Ux). If the increasing speed is slow, the return to the glow discharge may not be completed. In that case, the discharge drive circuit (Ux) maintains the arc discharge transition signal (Sa) as the negating logic, and the sequence may carry out from the impression of the unloaded open circuit voltage.

Incidentally, the state of the arc discharge transition signal (Sa) may be either negating logic or asserting logic when the lamp is turned off. However, since there is no advantage for the voltage conversion circuit (Ub) to supply high voltage to the discharge drive circuit (Ux), the state of the arc discharge transition signal (Sa) is maintained as asserting logic.

Description of voltage as the second voltage (Vt2) to be selected, at which the discharge drive circuit (Ux) can output the maximum voltage in the stationary arc discharge will be give below.

Since the lamp voltage in the stationary arc discharge state depends on the amount of discharge medium encapsulated in the discharge space and the distance between the electrodes which face each other, the lamp voltage is affected by production tolerance. Further, even though the same lamp is used, the electrodes are burned as the accumulated lighting time of the discharge lamp (Ld) increases. Therefore, the distance between the electrodes becomes longer thereby the lamp voltage in the stationary arc discharge state gradually becomes high.

As the accumulated lighting time of the discharge lamp (Ld) increases, the deposit of the evaporated electrode material on the container glass of the discharge lamp (Ld) increases. Therefore, the light transmission of the container glass drops and the lamp emission is deteriorated. Where the distance between the electrodes becomes longer as the accumulated lighting time increases, the approximation as a point source of the lamp is deteriorated. For Example, in case of an optical apparatus such as a projector, the usability of light drops and the projection screen becomes dark. Thus, since when the lamp voltage becomes high in the stationary arc discharge, it means that the life span of the lamp gets close to the end, in view of the actual practice, it is possible to set the maximum voltage in the stationary arc discharge as specification.

If the discharge lamp (Ld) is continuously used ignoring darkening of the lamp or projection screen, ultimately the life of the discharge lamp (Ld) ends due to breakdown of the discharge lamp (Ld). There are two types of breakdown of the lamp. One of them is burst of the lamp. Since the burst involves some danger, in view of safety, the maximum voltage in the stationary arc discharge is selected as specification. If the voltage reaches the maximum voltage, the discharge drive circuit (Ux) should be temporally stop to light the discharge lamp (Ld).

When the maximum voltage in the stationary arc discharge is determined, variable resistance load is connected instead of the discharge lamp (Ld) to the circuit. The resistance of the resistance load is gradually increased so as to find the resistance at which the maximum voltage can be generated. If, in the state, voltage applied to the discharge drive circuit (Ux) is decreased, the maximum voltage cannot be maintained at certain point. The voltage just before the maximum voltage cannot be maintained is selected as the second voltage (Vt2), that is, voltage at which the discharge drive circuit (Ux) can output maximum voltage in the stationary arc discharge.

In case that the discharge drive circuit (Ux) comprises, for example, a step down chopper as shown in the embodiments described below, the second voltage (Vt2) becomes approximately equal to value obtained by dividing the maximum voltage in the stationary arc discharge by the maximum value (DXmax described below in the embodiments) of the duty cycle ratio of the step down chopper switch element.

FIG. 2 is a block diagram showing a structure of a lamp lighting apparatus of another embodiment according to the present invention. In the figure, the voltage conversion circuit (Ub) comprises a boost chopper.

An operation of the boost chopper is described below.

First, a switch element (Qb) such as an FET etc. is turned on through a gate drive circuit (Gb) based on a gate drive signal (Sbg) from a voltage conversion controlling circuit (Fb). By applying voltage from the DC power supply (Em) to a common line (Cmn) through a coil (Lb), magnetic energy is accumulated. Next, the switch element (Qb) is turned off thereby releasing magnetic energy accumulated in the coil (Lb) so that higher voltage than the DC power supply is generated and charges are accumulated in a smoothing condenser (Cb) through flywheel diode (Db). Thus, by repeatedly turning off and on the switching element (Qb) periodically, the voltage from the DC power supply (Em) is converted to higher voltage than that from the DC power supply (Em) as an output of the voltage conversion circuit (Ub).

The voltage conversion controlling circuit (Fb) controls, in a feed-back manner, the "on period" to "on/off period" ratio of the switch element (Qb), that is, duty cycle ratio based on output voltage of the voltage conversion circuit (Ub), that is, voltage of the smoothing condenser (Cb) which is measured by a voltage detecting unit (Vb) comprising, for example, voltage dividing resistors etc. so that the output voltage of the voltage conversion circuit (Ub) attains the target value.

In case that the voltage conversion circuit (Ub) comprises the boost chopper, there is characteristic that the voltage from the DC power supply (Em) is directly applied to the discharge drive circuit (Ux) when the boost chopper stops operating, that is, when the switch element (Qb) is constantly turned off.

If the DC power supply (Em) is set to supply, as the second voltage (Vt2), enough voltage for the discharge drive circuit (Ux) to output the maximum voltage in the stationary arc discharge, it is possible to obtain the desired operation as the lamp lighting apparatus (Ex) by stopping the operation of the boost chopper when the voltage conversion circuit (Ub) receives the arc discharge signal (Sa) which is asserting logic.

That is, when the voltage conversion circuit (Ub) receives the arc discharge transition signal (Sa) which is negating logic, voltage from the DC power supply (Em) is boosted to the target voltage, that is, the first voltage (Vt1) which is selected as enough voltage for the discharge drive circuit (Ux) to output unloaded open circuit voltage, and the boosted voltage is supplied to the discharge drive circuit (Ux). On the contrary, when the voltage conversion circuit (Ub) receives the arc discharge transition signal (Sa) which is asserting logic, the voltage from the DC power supply (Em) is directly supplied to the discharge drive circuit (Ux), and since the voltage is more than the second voltage (Vt2), that is, enough voltage for the discharge drive circuit (Ux) to output the maximum voltage in the stationary arc discharge, even though the boost chopper stops, after that the arc discharge can be maintained.

As described above, in the lamp lighting apparatus (Ex), the boost chopper of the voltage conversion circuit (Ub) operates only at the very short period when high voltage is necessary for impression of unloaded open circuit voltage and to maintain glow discharge. At a period other than that period, that is, most lighting period, the boost chopper of the voltage conversion circuit (Ub) stops operating, loss due to the switching of the switch element (Qb) takes place at the limited period. Therefore, the temperature rise of the switching element (Qb) is slight during the limited period and therefore, there is advantage that the lamp lighting apparatus needs only a simple heat releasing structure.

In the structure of the lamp lighting apparatus shown in FIG. 2, when the voltage from the DC power supply (Em) changes to higher voltage, for example, voltage higher than the first voltage (Vt1), the boost chopper of the voltage conversion circuit (Ub) remains stopped when the voltage conversion circuit (Ub) receives the arc discharge transition signal (Sa) which is negating logic. Thus, there is no problem in the operation of the lamp lighting apparatus (Ex) even when the voltage from the DC power supply (Em) changes to higher voltage.

Next, an operation of a still another embodiment will be given below.

As described above, whether a state of the discharge lamp (Ld) changes to arc discharge, can be determined based on whether lamp voltage (VL) is an appropriately determined threshold voltage or less. The arc discharge transition signal (Sa) is changed from negating logic to asserting logic based on the result of the determination.

Thus, instead of generating the arc discharge transition signal (Sa) based on phenomenon that actually takes place with respect to the transition to arc discharge, it is possible, by relatively complex signal processing, to generate the arc discharge transition signal (Sa) on the same condition in every lighting, independently of phenomenon taking place actually as to the transition to arc discharge.

Since in case of an lamp lighting apparatus using high voltage pulse, the starter (Ui) may not be successful to initiate discharge by one shot, the starter (Ui) usually tries to initiate discharge at a repeat rate of a couple of hertz to a couple of thousand hertz. However, if the discharge is not initiated for some reasons, for safety the discharge drive circuit (Ux) is adapted so as to suspend the repeat trial of the discharge initiation during a limited period. Therefore, usually the starter (Ui) continues to operate for a predetermined maximum continuing time ($\tau$wi). In this case, a predetermined maximum continuing time ($\tau$Wi) is, but not limited to 3 seconds.

Accordingly, the maximum length of time from time when the lamp lighting apparatus (Ex) starts the operation of the starter (Ui) to the completion of the transition to arc discharge can be calculated by assuming that the discharge is initiated just before the expiration of the maximum continuing time ($\tau$wi), and that it takes the maximum necessary time ($\tau$wf) to complete the transition to the arc discharge. Thus, the maximum period by adding the maximum continuing time ($\tau$wi) to the maximum necessary time ($\tau$wf).

That is, the lamp lighting apparatus (Ex) changes the arc discharge transition signal (Sa) from negating logic to asserting logic after an approximately constant arc discharge transition waiting time ($\tau$wt) passes from a time of initiation of the operation of the starter (Ui) which is approximately calculated by adding the maximum continuing time ($\tau$wi) to the maximum necessary time ($\tau$wf).

Thus, in case that the arc discharge transition signal (Sa) is generated in the same condition, every time the lamp is lighted, independently of phenomenon that actually takes place as to the arc discharge transition, there is disadvantage that the voltage conversion circuit (Ub) is operated for unnecessary time thereby causing unnecessary loss to the voltage conversion circuit (Ub) but there are advantages that only a simple process(es) is required and it is certain that the discharge takes place.

As described above, the maximum necessary time ($\tau$wf) is 2 to 4 seconds, and the maximum continuing time ($\tau$wi) is 3 seconds, therefore, the arc discharge transition waiting time ($\tau$wt) is 5 to 7 seconds. Therefore, even though there is possibility that the unnecessary loss is caused to the voltage conversion circuit (Ub), the period causing the loss is very short. Thus, there are notable advantages over the prior art technology.

Although, in the above description, the arc discharge detecting circuit (Ua) is provided in addition to the discharge drive circuit (Ux) and the voltage conversion circuit (Ub), and a place where the arc discharge detecting circuit (Ua) is provided is not essential to the present invention. Thus, the arc discharge detecting circuit (Ua) may be provided inside the discharge drive circuit (Ux) or the voltage conversion circuit (Ub).

The present invention will become more apparent from the following detailed description of the embodiments and examples of the present invention.

DESCRIPTION OF THE DRAWINGS

FIGS. 12A, 12B, and 12C are schematic views conceptually showing changes of lamp voltage.

DETAILED DESCRIPTION OF THE INVENTION

Description of embodiments according to the present invention will be given below referring to drawings.

According to the present invention,

Description of the lamp lighting apparatus a first embodiment according to the present invention will be given below.

Figure 3:
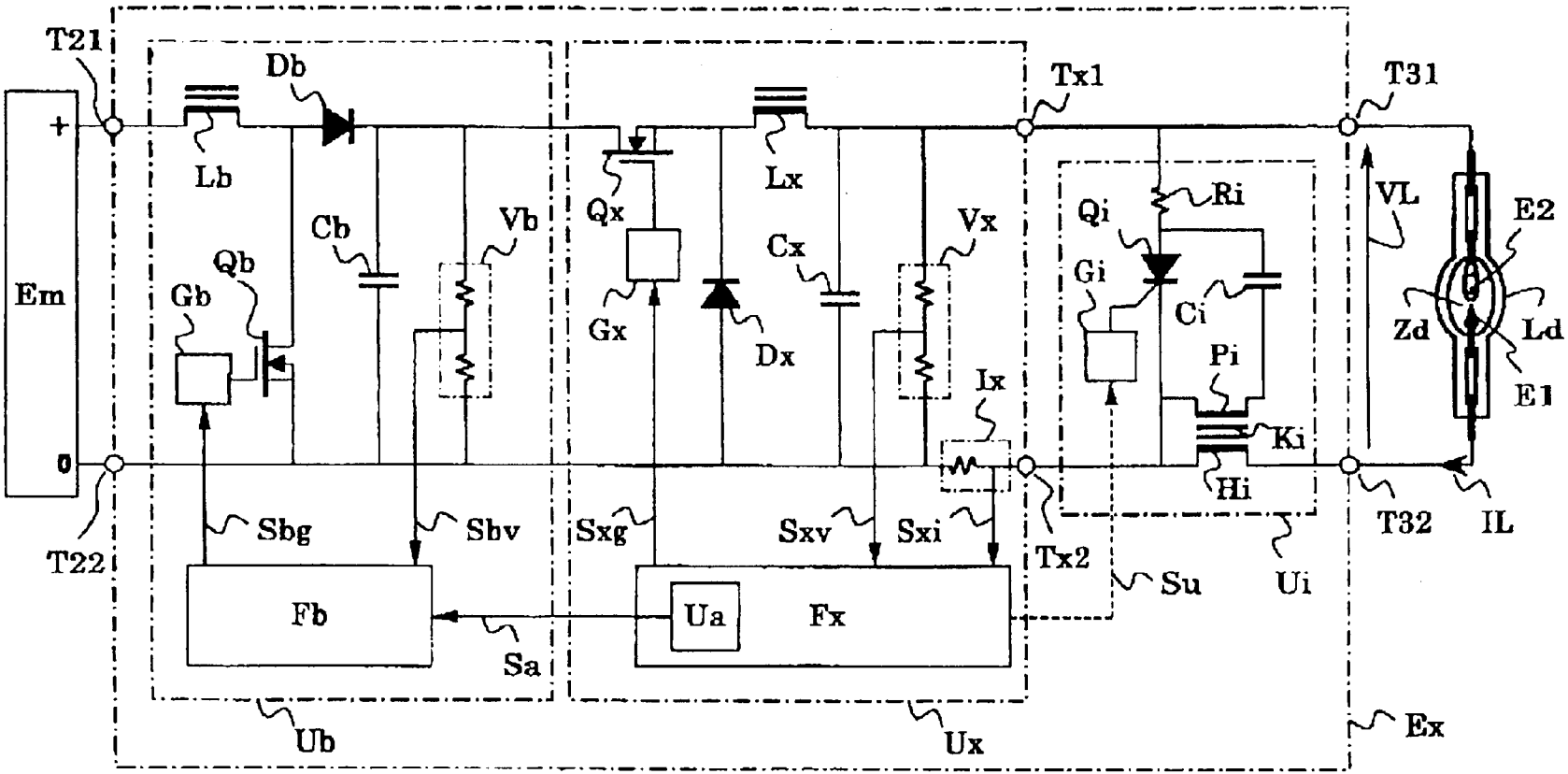
FIG. 3 shows the structure of a lamp lighting apparatus (Ex) according to the present invention.

FIG. 3 shows a schematic view of the lamp lighting apparatus (Ex) according to the present invention.

In the lamp lighting apparatus (Ex), the discharge drive circuit (Ux) comprising the step down chopper is operated by receiving voltage supply from the voltage conversion circuit (Ub). In the discharge drive circuit (Ux), a switch element (Qx) such as the FET etc. turns on and off current from the voltage conversion circuit (Ub), and a smooth condenser (Cx) is charged through a choke coil (Lx). The voltage is impressed to the discharge lamp (Ld) so that current flows through the discharge lamp (Ld).

While the switching element (Qx) is on, direct charge to the smoothing condenser (Cx) and current supply to the discharge lamp (Ld) are carried out by current flowing through the switching element (Qx), and at the same time, magnetic energy is accumulated in the choke coil (Lx). While the switching element (Qx) is off, the energy accumulated in the choke coil (Lx) is released so that charges to the smoothing condenser (Cx) through a flywheel diode (Dx) and current supply to the discharge lamp (Ld) are carried out.

In the starter (Ui), a condenser (Ci) is charged through a resistor (Ri) by lamp voltage (VL) which is impressed during the period unloaded open circuit voltage is generated. When the gate drive circuit (Gi) is activated, the switching element (Qi) comprising a thyristor etc. becomes conductive so that the charges accumulated in the condenser (Ci) is discharged through a primary winding (Pi) of the transformer (Ki), and a high voltage pulse is generated on a secondary winding (Hi).

The high voltage generated in the secondary winding (Hi) of the starter (Ui) is superimposed over output voltage of the discharge drive circuit (Ux) so as to apply between the electrodes (E1) and (E2) of the discharge lamp (Ld) thereby causing dielectric breakdown in the gap between the electrodes (E1) and (E2) and initiating discharge.

The discharge drive controlling circuit (Fx) generates a gate drive signal(s) (Sxg) having a certain duty cycle ratio. The gate drive signal (Sxg) is applied to a gate terminal of the switch element (Qx) through the gate drive circuit (Gx) thereby controlling to turn off and on the current from the voltage conversion circuit (Ub).

The lamp current (IL) flowing between the electrodes (E1) and (E2) and the lamp voltage (VL) generated between the electrodes (E1) and (E2) are detected by a voltage detecting unit (Vx) and a current detecting unit (Ix) respectively. A shunt resistor(s) is used for the current detecting unit (Ix) and voltage dividing resistors are used for the voltage detecting unit (Vx) thereby easily making up them.

A lamp current signal(s) (Sxi) outputted from the current detecting unit (Ix) and a lamp voltage signal(S) (Sxv) outputted from the voltage detecting unit (Vx) are inputted in the discharge drive controlling circuit (Fx). Based on a state of the discharge, that is, whether the state of discharge is non-discharge, glow discharge or arc discharge, the duty cycle ratio of a gate drive signal(s) (Sxg) is controlled in a feed-back manner by using the lamp current signal (Sxi) and the lamp voltage signal (Sxv) so as to reduce difference between a target value and the lamp current (IL), the lamp voltage (VL) or lamp power which is a product of the lamp current (IL) and the lamp voltage (VL).

Figure 4:
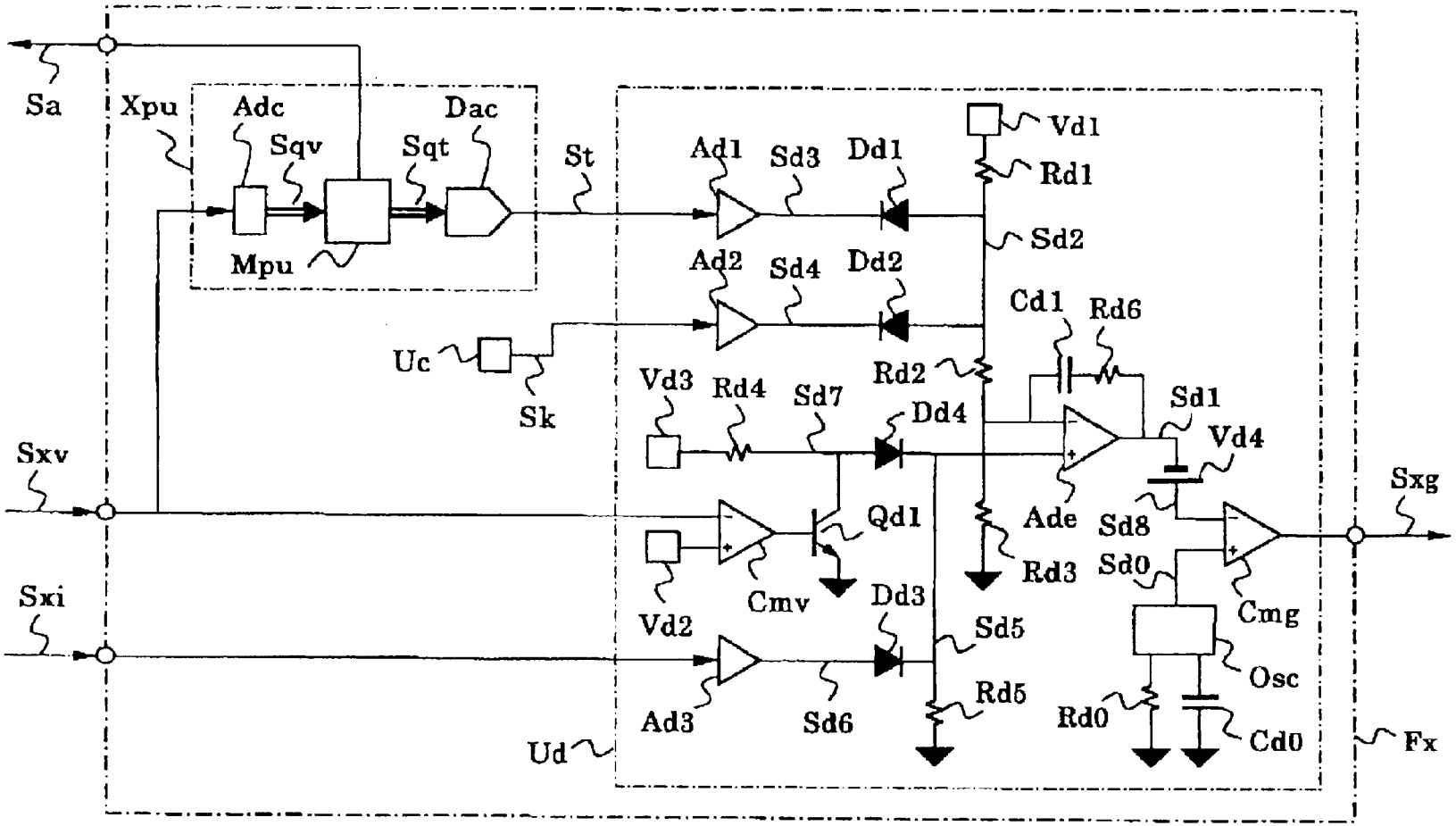
FIG. 4 shows an example of a discharge drive controlling circuit (Fx) of the lamp lighting apparatus according to the present invention.

FIG. 4 shows a schematic view of the structure of the discharge drive controlling circuit (Fx) shown in FIG. 3.

The lamp voltage signal (Sxv) is inputted in an AD converter (Adc) in an integrated controlling unit (Xpu) and converted into digital lamp voltage data (Sqv) having appropriate digits and then inputted in a micro processor (Mpu).

The micro processor unit (Mpu) has a CPU, a program memory (memories), a data memory (memories), a clock pulse generating circuit, a time counter, an input/output controlling unit for inputting and outputting digital signals.

The micro processor unit (Mpu) generates a chopper capability controlling target data (Sqt) for a drive capability controlling circuit (Ud) described below, based on a result calculated by referring the lamp voltage data (Sqv) and condition corresponding to a state of the system at that time. The chopper capability controlling target data (Sqt) is converted to an analogue chopper capability controlling target signal(s) (St) by a DA converter (Dac) so as to be inputted to the drive capability controlling circuit (Ud).

The micro processor unit (Mpu) also has a function of the arc discharge detecting circuit (Ua) so as to output the arc discharge transition signal (Sa). The micro processor unit (Mpu) sends, to the voltage conversion circuit (Ub), the arc discharge transition signal (Sa) as a high or low logic signal(s) in accordance with condition determined by the program processing which refers the lamp voltage data (Sqv) etc.

A lamp current upper limit signal(s) (Sk) for defining an upper limit of permissible lamp current (IL), that is, a permissible lamp current upper limit (ILmax) is generated by a lamp current upper limit signal generating circuit (Uc), and then inputted in the drive capacity controlling circuit (Ud).

In the drive capacity controlling circuit (Ud), the chopper capacity controlling target signal (St) is inputted through an amplifier or buffer (Ad1) provided if necessary and a diode (Dd1) to one end of a pull-up resistor (Rd1) and the lamp current upper limit signal (Sk) is inputted through a buffer (Ad2) and a diode (Dd2) to the one end of the pull-up resistor (Rd1), thereby generating a chopper drive target signal(s) (Sd2). The other end of the pull-up resistor (Rd1) is connected to a reference voltage (Vd1) which generates appropriate voltage.

Therefore, one of signals (a signal (Sd3) corresponding to the chopper capacity controlling target signal (St) and a signal (Sd4) corresponding to the lamp current upper limit signal (Sk)) which is not the higher is selected as the chopper drive target signal (Sd2).

Therefore, in case that the chopper capability controlling target signal (St) is generated in some manner, for example, in a manner that the integrated controlling unit (Xpu) generates the chopper capability controlling target signal (St) by dividing a constant number corresponding to the rated apparent voltage by the lamp voltage data (Sqv) so as to calculate a value of the lamp current (IL) for outputting rated apparent power, even though it is not inappropriate, in the drive capability controlling circuit (Ud), in a hardware manner, the chopper drive target signal (Sd2) is controlled so that the lamp current (IL) does not exceed the value of the lamp current upper limit signal (Sk).

Since the processing speed of control using the AD converter (Adc) and/or the micro processor (Mpu) is slow or processing at high speed causes cost rise, where, for example, a state of the discharge lamp changes rapidly, unsuitableness of the chopper capability controlling target signal (St) may occur due to the delay of the performance. Thus, it is advantageous that the current controlling function is carried out in a hardware manner in view of protection of the lamp and lamp lighting apparatus.

On the other hand, the lamp current signal (Sxi) is connected through an amplifier or buffer (Ad3), which is provided if necessary, and a diode (Dd3) is connected to one end of a pull-down resistor (Rd5) which is connected to ground at the other end so that a control target signal (Sd5) is generated.

Further, by a comparator (Cmv), the lamp voltage signal (Svx) is compared with the voltage of the standard voltage source (Vd2) which corresponds to unloaded open circuit voltage. If the lamp voltage signal (Svx) is higher than the unloaded open circuit voltage, a transistor (Qd1) is turned off or becomes active, and current from an appropriate power source (Vd3) flows through the pull down resistor (Rd5) through a resistor (Rd4) and a diode (Dd4) thereby pulling up the level of the control target signal (Sd5).

On the other hand, the lamp voltage signal (Sxv) is lower than the unloaded open circuit voltage, the transistor (Qd1) is turned on so that the current from the standard voltage source (Vd3) is shorted, the control target signal (Sd5) becomes a signal corresponding to the lamp current signal (Sxi).

That is, in the circuit comprising the pull-down resistor (Rd5), the diode (Dd3), the diode (Dd4), one of the signals (Sd6) and (Sd7) on the anode side of these diodes (Dd3) and (Dd4), which is not the lower is selected and applied to the pull-down resistor (Rd5).

In the comparator (Cmv), by, for example, inserting a positive feedback resistor between the output terminal and a non-inverting input terminal, it is possible for the comparator to have hysteresis characteristic in the comparison operation so that it is possible to prevent oscillation phenomenon not intended at the time when the comparison output changes.

As such, even though output current almost stops flowing and the lamp current signal (Six) is almost not inputted, if the lamp current voltage signal (Svx) starts increasing to more than the unloaded open circuit voltage, the control target signal (Sd5) rises rapidly so that the lamp voltage (VL) is always controlled so as to be approximately less than the unloaded open circuit voltage by the hardware.

The chopper drive target signal (Sd2) is divided by the resistors (Rd2) and (Rd3) and applied to an inverting input terminal of an operational amplifier (Ade). On the other hand, the control target signal (Sd5) is inputted to the noninverting input terminal of the operational amplifier (Ade). Since the output signal (Sd1) of the operational amplifier (Ade) is fed back through an integration condenser (Cd1) and a speed-up resistor (Rd6) to the inverting input terminal, the operational amplifier (Ade) functions as an error integration circuit for integrating voltage difference between the voltage of the control target signal (Sd5) and the voltage obtained by dividing the chopper drive target signal (Sd2) by the resistors (Rd2) and (Rd3).

Figure 5:
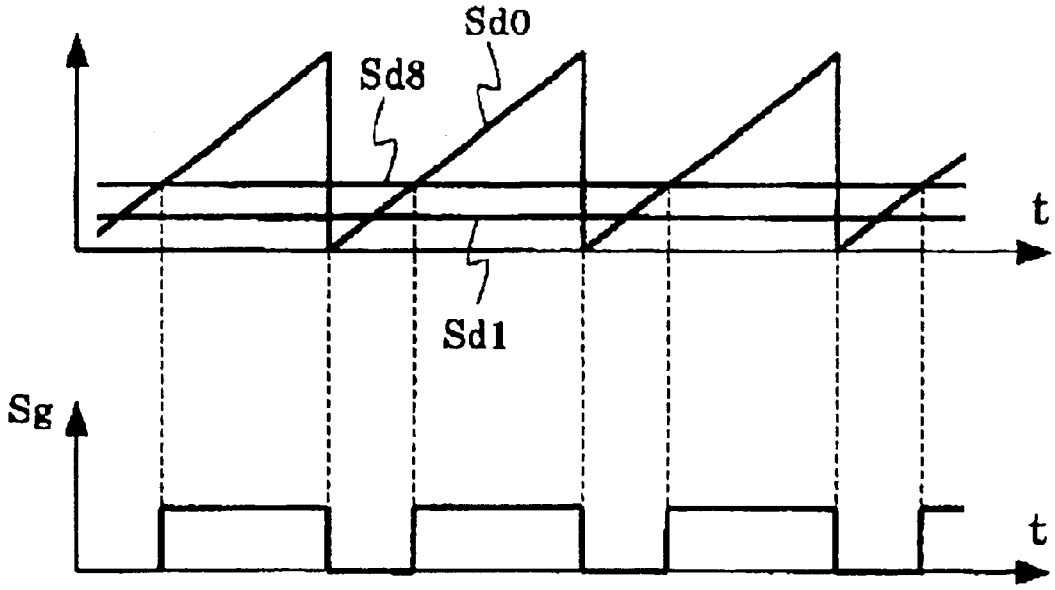
FIG. 5 is a diagram for explaining an operation of a PWM circuit of the lamp lighting apparatus according to the present invention.

An oscillator (Osc) to which a resistor (Rd0) and a condenser (Cd0) for determining a time constant are connected generates a saw-tooth wave signal (Sd0) shown as "a" in FIG. 5. The saw-tooth wave signal (Sd0) and an output signal (Sd1) of the error integration circuit are compared by the comparator (Cmg).

In case of the comparison, a signal (Sd8) is generated by adding offset voltage (Vd4) to the output signal (Sd1) of the error integration circuit, and the signal (Sd8) is compared with the saw-tooth wave signal (Sd0).

A gate drive signal (Sgx) that becomes high when the voltage of the saw-tooth wave signal (Sd0) is higher than that of the signal (Sd8), is generated and outputted from the chopper capability controlling circuit (Ud).

As described above, since the signal (Sd8) is one in that the offset voltage is added to the output signal (Sd1) of the error integration circuit, even though the output signal (Sd1) of the error integration circuit is zero, the duty cycle ratio of the gate drive signal (Sxg) is controlled to a certain maximum value which is less than 100 percent, that is, less than the maximum duty cycle ratio DXmax.

As shown as "a" and "b" in FIG. 5, the relationship among the output signal (Sd1) of the error integration circuit, the signal (Sd8) which is generated by adding the offset voltage to the output signal (Sd1), the saw-tooth wave signal (Sd0) and the gate drive signal (Sxg) is shown. The gate drive signal (Sxg) outputted from the discharge drive controlling circuit (Fx) is inputted in the gate drive circuit (Gx) and as a result, a feedback controlling system in which the lamp current signal (Sxi) and the lamp voltage signal (Sxv) are fed back to the operation of the switching element (Qx) is completed.

For the drive capability controlling circuit (Ud) shown in FIG. 4, a commercially available integrated circuit, such as TL494™ (TEXAS INSTRUMENTS) in which the operational amplifier (Ade), the oscillator (Osc), and comparator (Cmg) etc. are integrated, may be used.

Figure 1:
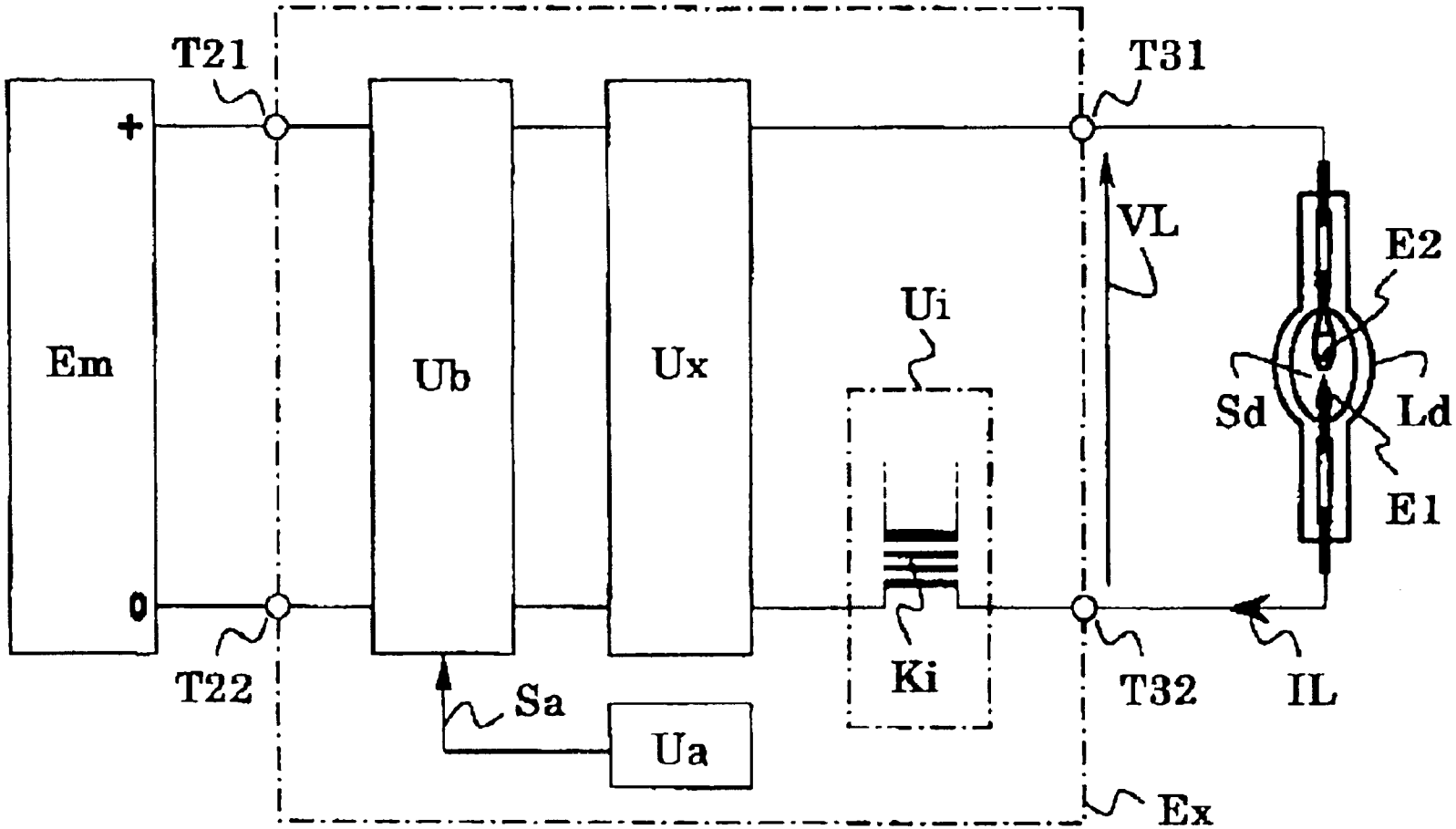
FIG. 1 shows the structure of a lamp lighting apparatus (Ex) according to the present invention.
Figure 2:
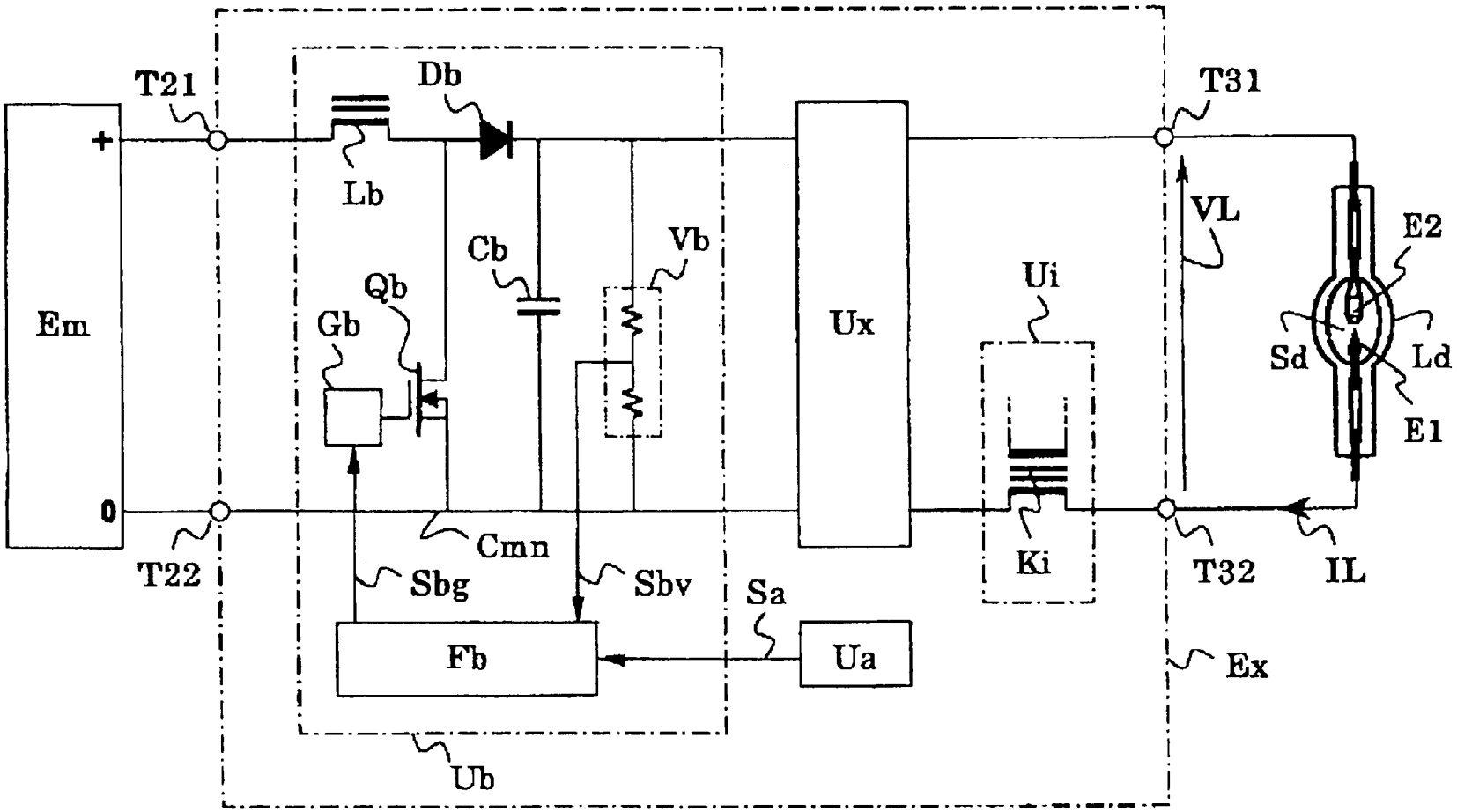
FIG. 2 shows the structure of a lamp lighting apparatus (Ex) according to the present invention.
Figure 6:
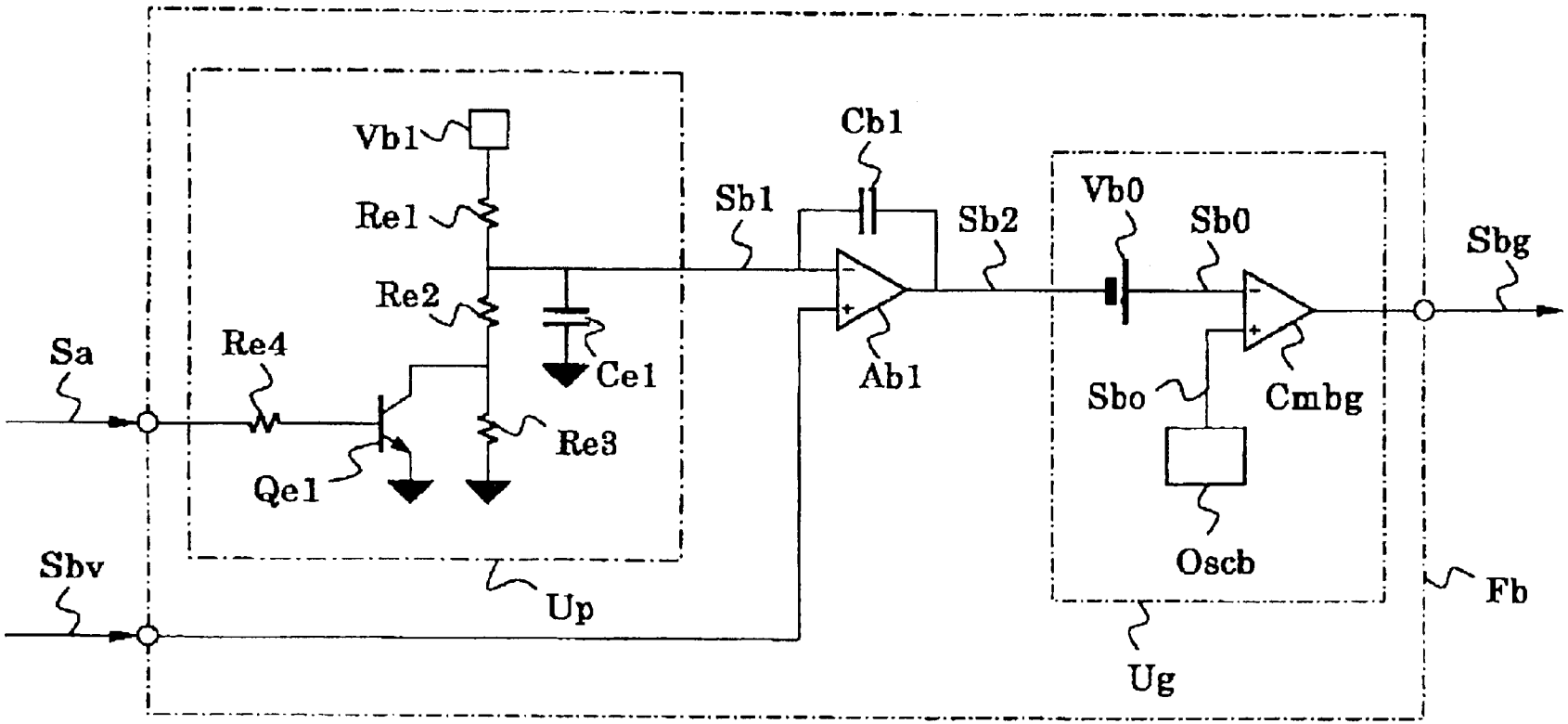
FIG. 6 shows an example of the structure of a voltage conversion circuit (Fb) of the lamp lighting apparatus (Ex) according to the present invention.

On the other hand, in FIG. 3, a voltage conversion circuit (Ub) comprising a boost chopper which is the same as that shown in FIG. 2. is shown. FIG. 6 shows a schematic structure of the voltage conversion controlling circuit (Fb) shown in FIG. 3.

The conversion output voltage signal (Sbv) obtained from the voltage detecting unit (Vb), which represents the output voltage of the voltage conversion circuit (Ub), is inputted to the non-inverting input terminal of an operational amplifier (Ab1). A controlling target signal(s) (Sb1) that corresponds to the target value of the conversion output voltage signal (Sbv) and that is generated by dividing voltage of appropriate standard voltage (Vb1) by resistors (Re2) and (Re3) and a resistor (Re1) is inputted to an inverting input terminal of the operational amplifier (Ab1). Since the output signal of the operational amplifier (Ab1) is fed back through an integration condenser (Cb1) to the inverting input terminal of the operational amplifier (Ab1), the operational amplifier (Ab1) functions as an error integration circuit for integrating difference between the voltage of the controlling target signal (Sb1) and voltage of the conversion output voltage signal (Sbv).

A signal (Sb2) outputted from the operational amplifier (Ab1) is converted into a gate drive signal(s) (Sbg) by a PWM circuit (Ug) comprising an offset voltage source (Vb0), a comparator (Cmbg), and an oscillator (Oscb). The PWM circuit (Ug) functions on the same principle as that of the PWM circuit comprising the offset voltage source (Vd4), the comparator (Cmg), and oscillator (Osc) shown in FIG. 4. Thus, the voltage conversion circuit (Ub) controls in a feedback manner the voltage of the conversion output voltage signal (Sbv), that is, the output voltage of the voltage conversion circuit (Ub) so that error of the conversion output voltage signal (Sbv) to the control target signal (Sb1) becomes small.

For the voltage conversion controlling circuit (Fb) shown in FIG. 6, a commercially available integrated circuit, such as TL494™ (TEXAS INSTRUMENTS) in which the operational amplifier (Ab1), the oscillator (Oscb), and comparator (Cmbg) etc. are integrated, may be used.

The arc discharge transition signal (Sa) sent from the micro processor unit (Mpu) of the discharge drive controlling circuit (Fx) of the discharge drive circuit (Ux) is inputted through a resistor (Re4) of a dividing voltage switching circuit (Up) to the base of a transistor (Qe1).

When the arc discharge transition signal (Sa) is low, the transistor (Qe1) is turned off, and the arc discharge transition signal (Sa) is high, the transistor (Qe1), is turned on. Since the resistor (Re3) is shorted when the transistor (Qe1) is on, the control target signal (Sb1) becomes low. Since the resistor (Re3) is not shorted when the transistor (Qe1) is off, the control target signal (Sb1) becomes high.

As described above, since the output voltage of the voltage conversion circuit (Ub) is controlled in a feedback manner so as to correspond to voltage of the control target signal (Sb1), resistance of the resistors (Re2) and (Re3) is adapted so that when the arc discharge transition signal (Sa) becomes false logic, that is, low, the output voltage of the voltage conversion circuit (Ub) becomes the first voltage (Vt1), and when the arc discharge transition signal (Sa) becomes truth logic, that is, high, the output voltage of the voltage conversion circuit (Ub) becomes the second voltage (Vt2).

As described above, each of processes, that is, initiation, glow discharge, and arc discharge transition, and actual control and sequence before the lamp lighting apparatus (Ex) according to the present invention shown in FIG. 3 starts operating are described below.

When the lamp lighting apparatus (Ex) is initiated, the integrated controlling unit (Xpu) makes the output voltage of the voltage conversion circuit (Ub) to the first voltage (vt1) by changing the arc discharge transition signal (Sa) to false logic. Further, as described above, for glow discharge, the chopper capability control target signal (St) is set to a sufficiently high level so that the lamp current upper limit signal (Sk) is selected as the chopper drive target signal (Sd2). At this point, the discharge lamp (Ld) is turned off, and lamp current (IL) does not flow thereby coming into a state in which the unloaded open circuit voltage is generated. This state corresponds to a period (τ11) shown in FIG. 12A which conceptually shows changes of the lamp voltage (VL) and the voltage (VL) with respect to passage of time.

At a point (ta0), dielectric breakdown takes place by operating the starter (Ui) to impress high voltage between the electrodes (E1) and (E2) as described above, thereby initiating glow discharge. The period of the glow discharge is show as (τ12) in FIG. 12A.

As described above, since the lamp voltage (VL) rapidly drops when the state of the lamp changes to arc discharge, the integrated controlling unit (Xpu) which is detecting the lamp voltage signal (Sxv) through the AD converter (Adc) can detect the transition of a state of the lamp to the arc discharge by detecting the rapid drop of the lamp voltage (VL). Or, as shown in FIG. 12B, it is possible to detect the transition of a state of the lamp to arc discharge, based on the appropriate process including the grace period as described above, in order to prepare for a case where the state of the lamp changes to arc discharge after changing to glow discharge after transition to arc discharge or the state of the lamp changes to arc discharge after these transitions are repeated.

When the transition of a state of the lamp to the arc discharge is detected, the integrated controlling unit (Xpu) makes the output voltage of the voltage conversion circuit (Ub) to more than the second voltage (Vt2) by changing the arc discharge transition signal (Sa) to truth logic. Further, instead of the operation for setting the chopper capability controlling target signal (St) to the sufficiently high level so as to select the lamp current upper limit signal (Sk) as the chopper drive target signal (Sd2) for the glow discharge, operations for approximately regularly detecting the lamp voltage (VL), calculating target current by dividing target power by the detected lamp voltage (VL), and repeatedly setting the calculated target current as the chopper capability controlling target signal (St) is initiated.

As described above, since in the initial period of the arc discharge, temperature of the lamp has not sufficiently risen and the calculated target current exceeds the permissible upper limit lamp current ILmax, the target current cannot be met. As time passes, the temperature of the lamp rises and the target current becomes the permissible upper limit lamp current ILmax or less so that it is possible to apply the target power.

At the period at which the integrated controlling unit (Xpu) maintains the arc discharge transition signal (Sa) as false logic, the output voltage of the voltage conversion circuit (Ub) is maintained at the first voltage (Vt1) at which the discharge drive circuit (Ux) can sufficiently output the unloaded open circuit voltage.

After the integrated controlling unit (Xpu) changes the arc discharge transition signal (Sa) from the false logic to truth logic, the output voltage of the voltage conversion circuit (Ub) is maintained at low voltage, that is, the second voltage (Vt2) at which the discharge drive circuit (Ux) can sufficiently output the maximum voltage in the stationary arc discharge thereby controlling the switching loss of the voltage conversion circuit (Ub) and the discharge drive circuit (Ux) to a low level since the voltage is low.

When the integrated controlling unit (Xpu) detects the transition of a state of the lamp to the arc discharge, after the predetermined approximately constant arc discharge transition waiting time (τwt) beginning from the initial operation of the starter (Ui), the integrated controlling unit (Xpu) may change the arc discharge transition signal (Sa) to truth logic.

In the voltage conversion controlling circuit (Fb) as shown in FIG. 6, as one of examples, a condenser (Ce1) is connected to the control target signal (Sb1) so as to make the switching of the control target signal (Sb1) slow when the arc discharge transition signal (Sa) changes thereby preventing the output voltage of the voltage conversion circuit (Ub) from rapidly changing.

When the state of the discharge changes to the arc discharge and the output voltage of the voltage conversion circuit (Ub) drops, the discharge drive circuit (Ux) has to increase the duty cycle ratio of the switch element (Qx) in order to maintain the discharge. If the output voltage of the voltage conversion circuit (Ub) drops so rapidly that the increase of the duty cycle of the switching element (Qx) cannot catch up with the drop, there is possibility that the discharge of the lamp is lost. If such phenomenon does not take place, the condenser (Ce1) is not necessary.

In this embodiment, the micro processor unit (Mpu) in the discharge drive circuit (Ux) has a function of the arc discharge detecting circuit (Ua). Therefore, the arc discharge transition signal (Sa) is outputted from the discharge drive circuit (Ux). The same is true for the embodiments described below.

Next, a second embodiment of the lamp lighting apparatus according to the present invention will be described. The description will be given, referring to the first embodiment.

Figure 7:
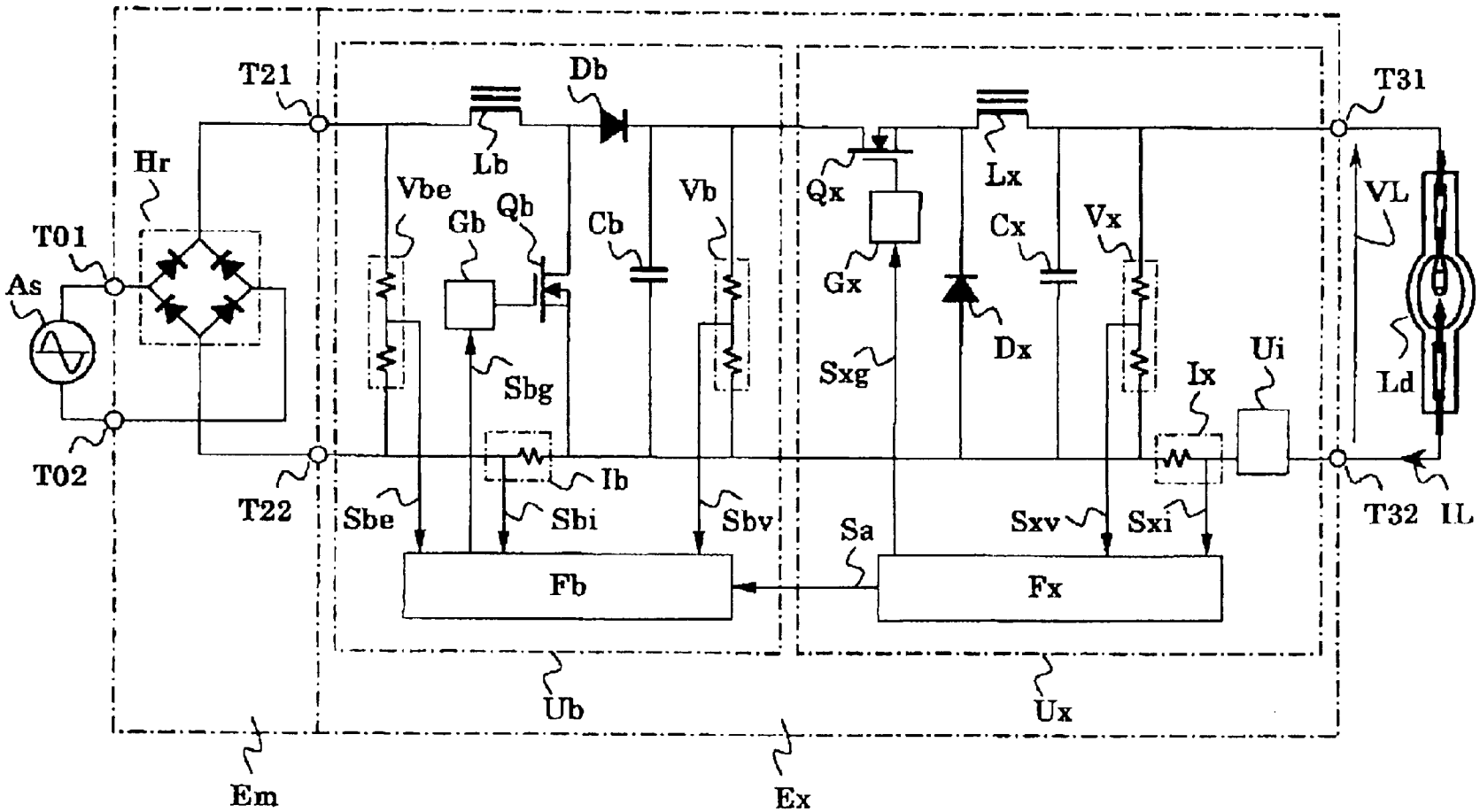
FIG. 7 shows an example of the structure of the lamp lighting apparatus according to the present invention.
Figure 13:
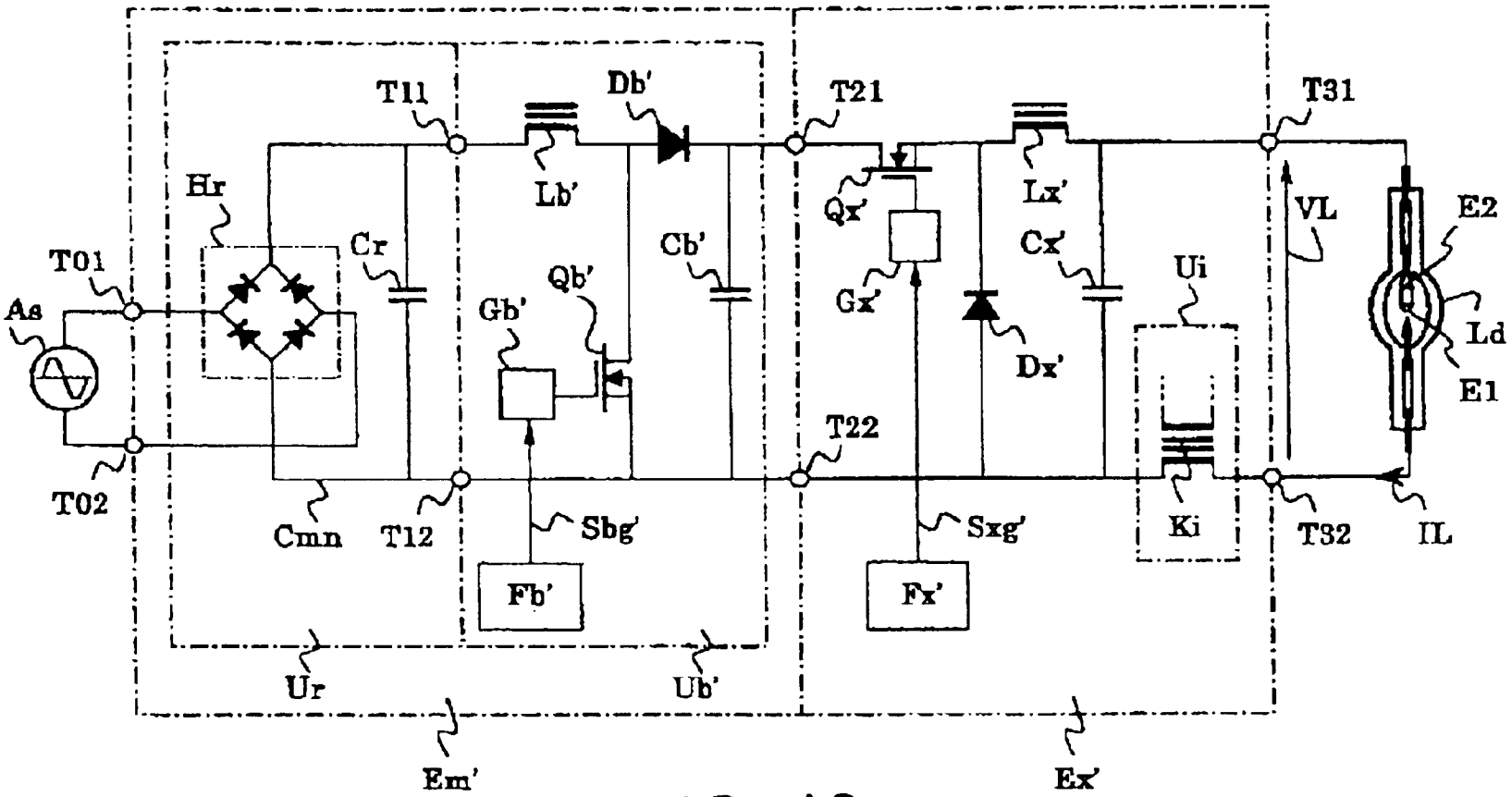
FIG. 13 shows the structure of a conventional lamp lighting apparatus according to the present invention.

FIG. 7 shows a simplified example in which, in a light source apparatus, when the lamp lighting apparatus (Ex) receives power from the DC power supply including the booster circuit (Ub') as shown in FIG. 13, the voltage conversion circuit (Ub) according to the present invention has a function of the booster circuit (Ub') and a function of a power factor controller is added the voltage conversion circuit (Ub).

In this example, a discharge drive circuit (Ux) comprising a step-down chopper which is the same as that in FIG. 3 and the voltage conversion circuit (Ub) comprising a boost chopper are used. However, in addition to the conversion output voltage signal (Sbv) generated by the voltage detecting unit (Vb), a rectification voltage signal(s) (Sbe) generated by a rectification voltage detecting unit (Vbe) and an output current signal (Sbi) generated by a output current detecting unit (Ib) are inputted to the voltage conversion controlling circuit (Fb).

Figure 8:
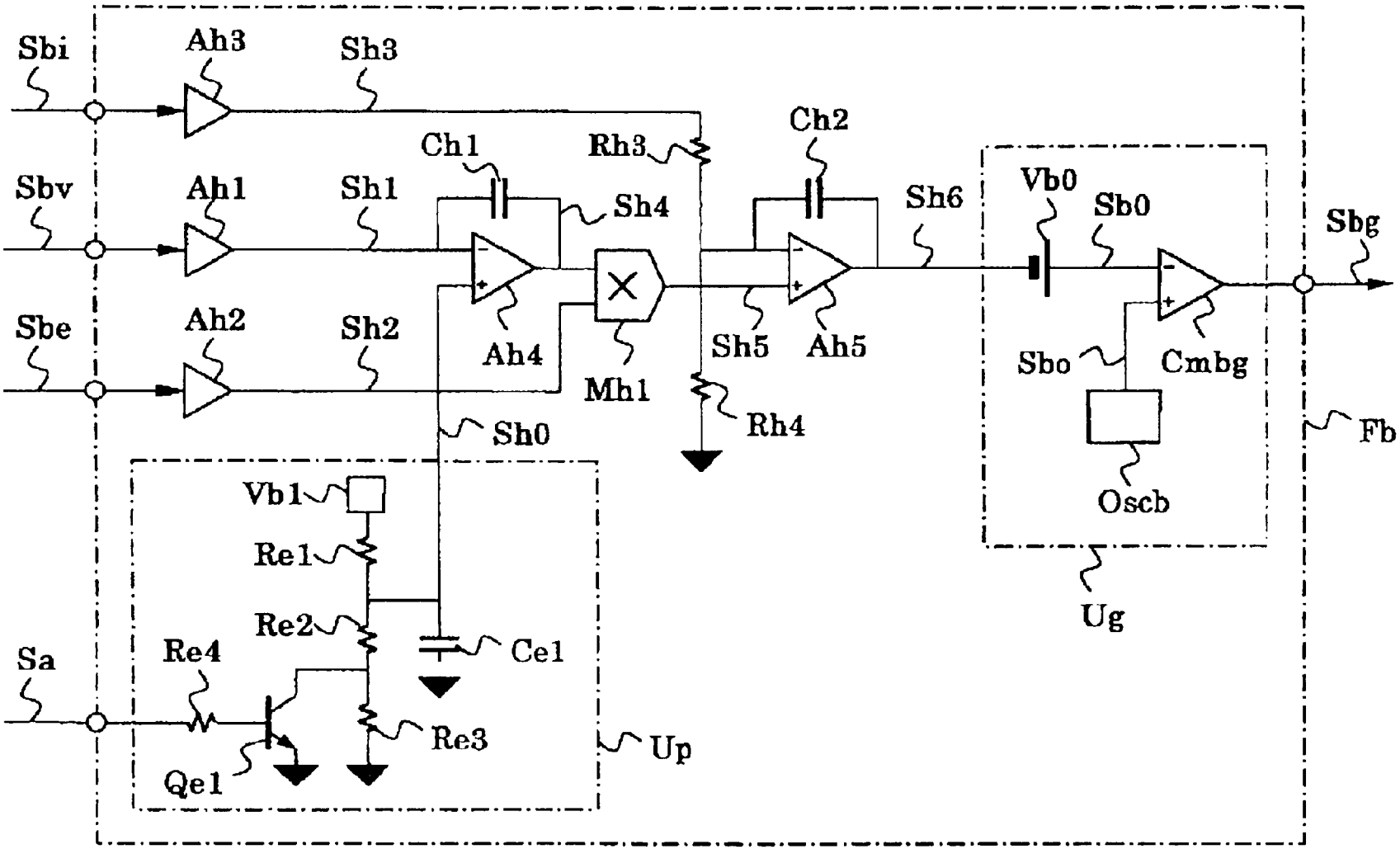
FIG. 8 shows an example of the structure of voltage conversion circuit (Fb) of the lamp lighting apparatus according to the present invention.

FIG. 8 shows a simplified structure of the voltage conversion controlling circuit (Fb) shown in FIG. 7.

A signal (Sh1) corresponding to the conversion output voltage signal (Sbv) inputted through an amplifier or a buffer (Ah1) which is provided if necessary is inputted to an inverting input terminal of an operational amplifier (Ah4). A control target signal (Sh0) for determining the target value of the output voltage of the voltage conversion circuit (Ub) is inputted to a non-inverting input terminal of the operational amplifier (Ah4).

Since the output of the operational amplifier (Ah4) is fed back to the inverting input terminal through an integration condenser (Ch1), the operational amplifier (Ah4) functions as an error integration circuit for integrating difference between the signal (Sh1) corresponding to the conversion output voltage signal (Sbv) and the target value of the output voltage defined by the control target signal (Sh0) thereby generating output voltage error integration signal (Sh4).

The rectification voltage signal (Sbe) inputted through an amplifier or a buffer (Ah2) which is provided if necessary, along with the output voltage error integration signal (Sh4), is inputted to a multiplier (Mh1) thereby generating a current target signal (Sh5) which is obtained by multiplying these two signals.

In case of the multiplication, in order to make it easy to obtain signal level matching, the signal (Sh2) and the output voltage error integration signal (Sh4) are standardized by an average value of the signal (Sh2).

On the other hand, a signal (Sh3) corresponding to an output current signal(s) (Sbi) inputted through an amplifier or a buffer (Ah3) which is provided if necessary, such as signal polarity matching, is divided by resistors (Rh1) and (Rh2) and then inputted to the inverting input terminal of the operational amplifier (Ah5). The current target signal (Sh5) is inputted to the non-inverting input terminal of the operational amplifier (Ah5).

Since the output of the operational amplifier (Ah5) is fed back to the inverting input terminal through an integration condenser (Ch2), the operational amplifier (Ah5) functions as an error integration circuit for integrating difference between the signal (Sh3) corresponding to the output current signal (Sbi) and the target value of the output current defined by the control target signal (Sh5) thereby generating output current error integration signal (Sh6).

The operation of the PMW circuit (Ug) comprising an offset voltage source (Vb0), a comparator (Cmbg) and an oscillator (Oscb) is the same as that shown in FIG. 6. That is, a gate drive signal(s) (Sbg) is generated and outputted from the voltage conversion controlling circuit (Fb).

By the structure of the voltage conversion controlling circuit (Fb), the voltage conversion circuit (Ub) functions as a booster circuit having a function of a power factor controller.

That is, as described above, the difference (or error) between the target voltage of the output voltage defined by the control target signal (Sh0) and (a signal corresponding to) the conversion output voltage signal (Sbv) is integrated by the error integration circuit comprising the operational amplifier (Ah4) thereby generating the output voltage error integration signal (Sh4). Since the circuit is driven by the output voltage error integration signal (Sh4), the output voltage of the voltage conversion circuit (Ub) is controlled in a feedback manner so as to reduce the difference between the target value and the output voltage thereby functioning as a stabilized power source.

The output voltage error integration signal (Sh4) is modulated by the multiplier (Mh1) using a signal(s) corresponding to the rectification voltage signal (Sbe) thereby generating the current target signal (Sh5) having a full-wave rectification voltage wave form. Difference between the current target signal (Sh5) and (a signal(s) corresponding to) the output current signal (Sbi) is integrated by the error integration circuit comprising the amplifier (Ah5) so that the output current error integration signal (Sh6) is generated thereby driving the circuit. Thus, the output current signal (Sbi) is controlled in a feedback manner so as to reduce the difference between the target value and the output current signal (Sbi). As a result, a wave form of current inputted from the commercial power supply (Ax) to the voltage conversion circuit (Ub) and that of voltage of the commercial power supply (Ax) are similar to each other so that the harmonic component is controlled and the power factor is improved.

For the voltage conversion controlling circuit (Fb) shown in FIG. 13, a commercially available integrated circuit, such as UC3854™ (TEXAS INSTRUMENTS) in which the operational amplifier (Ah4), the multiplier (Mh1), the amplifier (Ah5), the oscillator (Oscb), and comparator (Cmbg) etc. are integrated, may be used.

The control target signal (Sh0) is generated by a dividing voltage switching circuit (Up) that functions in the same manner as the dividing voltage switching circuit (Up) shown in FIG. 6, based on the arc discharge transition signal (Sa) sent from the micro processor unit (Mpu) of the discharge drive controlling circuit (Fx) of the discharge drive circuit (Ux).

Accordingly, since the output voltage of the voltage conversion circuit (Ub) is controlled in a feedback manner so as to correspond to voltage of the control target signal (Sb0), resistance of the resistors (Re2) and (Re3) is adapted so that when the arc discharge transition signal (Sa) becomes false logic, that is, low, the output voltage of the voltage conversion circuit (Ub) becomes the first voltage (Vt1), and when the arc discharge transition signal (Sa) becomes truth logic, that is, high, the output voltage of the voltage conversion circuit (Ub) becomes the second voltage (Vt2).

Thus, by such a structure, the voltage conversion circuit (Ub) functions as a power factor controller. Further, during the period for which the integrated controlling unit (Xpu) maintains the arc discharge transition signal (Sa) as false logic, the output voltage of the voltage conversion circuit (Ub) is maintained at the first voltage (Vt1) at which the discharge drive circuit (Ux) can sufficiently output the unloaded open circuit voltage. After the integrated controlling unit (Xpu) changes the arc discharge transition signal (Sa) from the negating logic to asserting logic, the output voltage of the voltage conversion circuit (Ub) is maintained at low voltage, that is, the second voltage (Vt2) at which the discharge drive circuit (Ux) can sufficiently output the maximum voltage in the stationary arc discharge thereby controlling the switching loss of the voltage conversion circuit (Ub) and the discharge drive circuit (Ux) to a low level since the voltage is low.

When the integrated controlling unit (Xpu) detects the transition of a state of the lamp to the arc discharge, after the predetermined approximately constant arc discharge transition waiting time (τwt) beginning from the initial operation of the starter (Ui), the integrated controlling unit (Xpu) may change the arc discharge transition signal (Sa) to truth logic.

Next, a third embodiment of the lamp lighting apparatus according to the present invention will be described. The description will be given, referring to the second embodiment.

Figure 9:
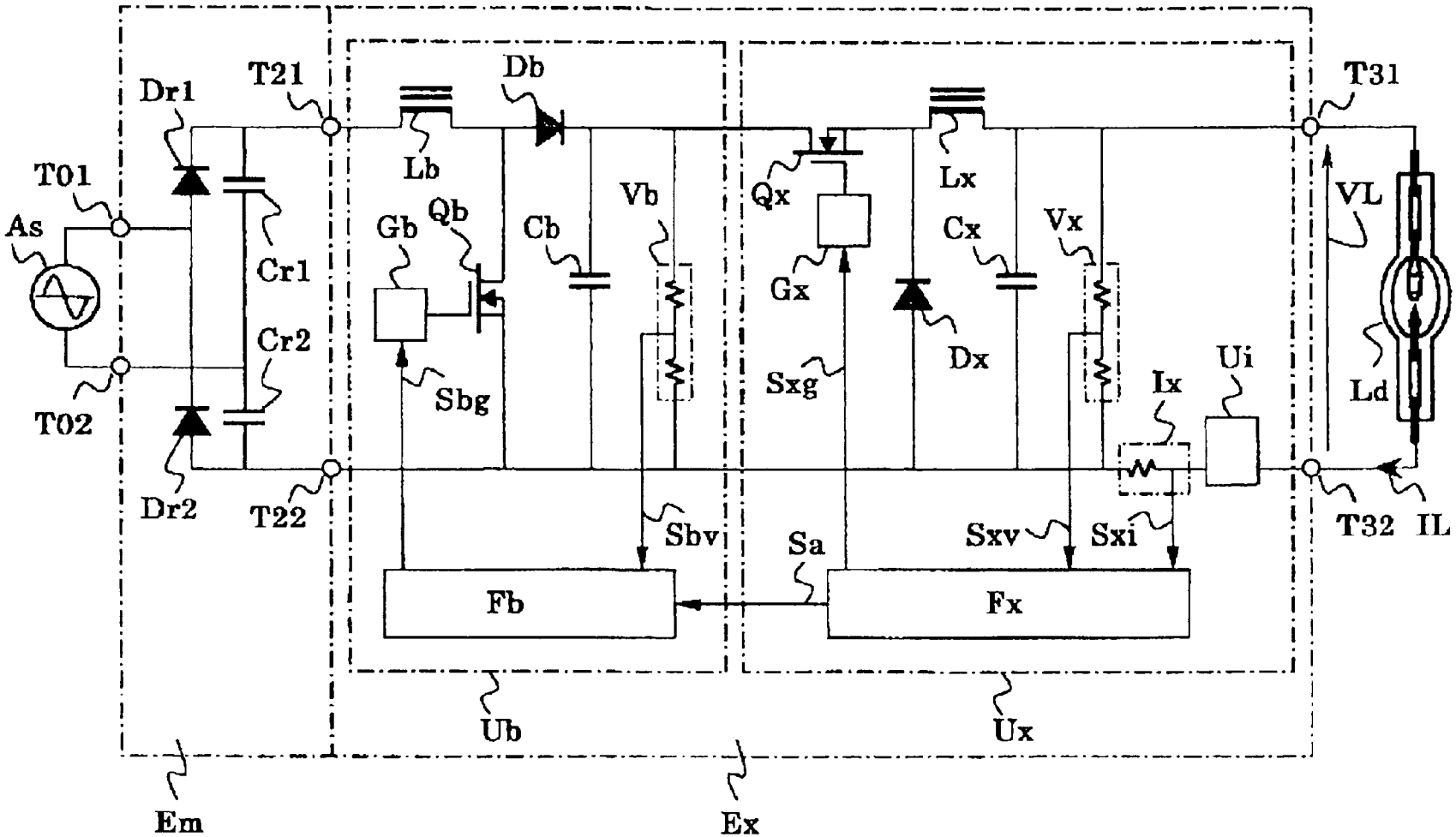
FIG. 9 shows an example of the structure of the lamp lighting apparatus according to the present invention.

FIG. 9 shows a simplified example in which, in a light source apparatus, the lamp lighting apparatus (Ex) receives power from the DC power supply which does not have the booster circuit (Ub') as shown in FIG. 13.

In this example, a discharge drive circuit (Ux) comprising a step-down chopper which is the same as that shown in FIG. 3 and the voltage conversion circuit (Ub) comprising a boost chopper are used. In case of the rectification circuit having a diode bridge (Hr) shown in FIG. 13, since in an area where voltage of the commercial power supply (As) is AC 100 V, the voltage is not enough for the discharge drive circuit (Ux) to output the maximum voltage in stationary arc discharge, as the second voltage (Vt2), a double voltage rectification circuit comprising diodes (Dr1) and (Dr2), and smoothing condensers (Cr1) and (Cr2) are used as a rectification circuit.

Figure 10:
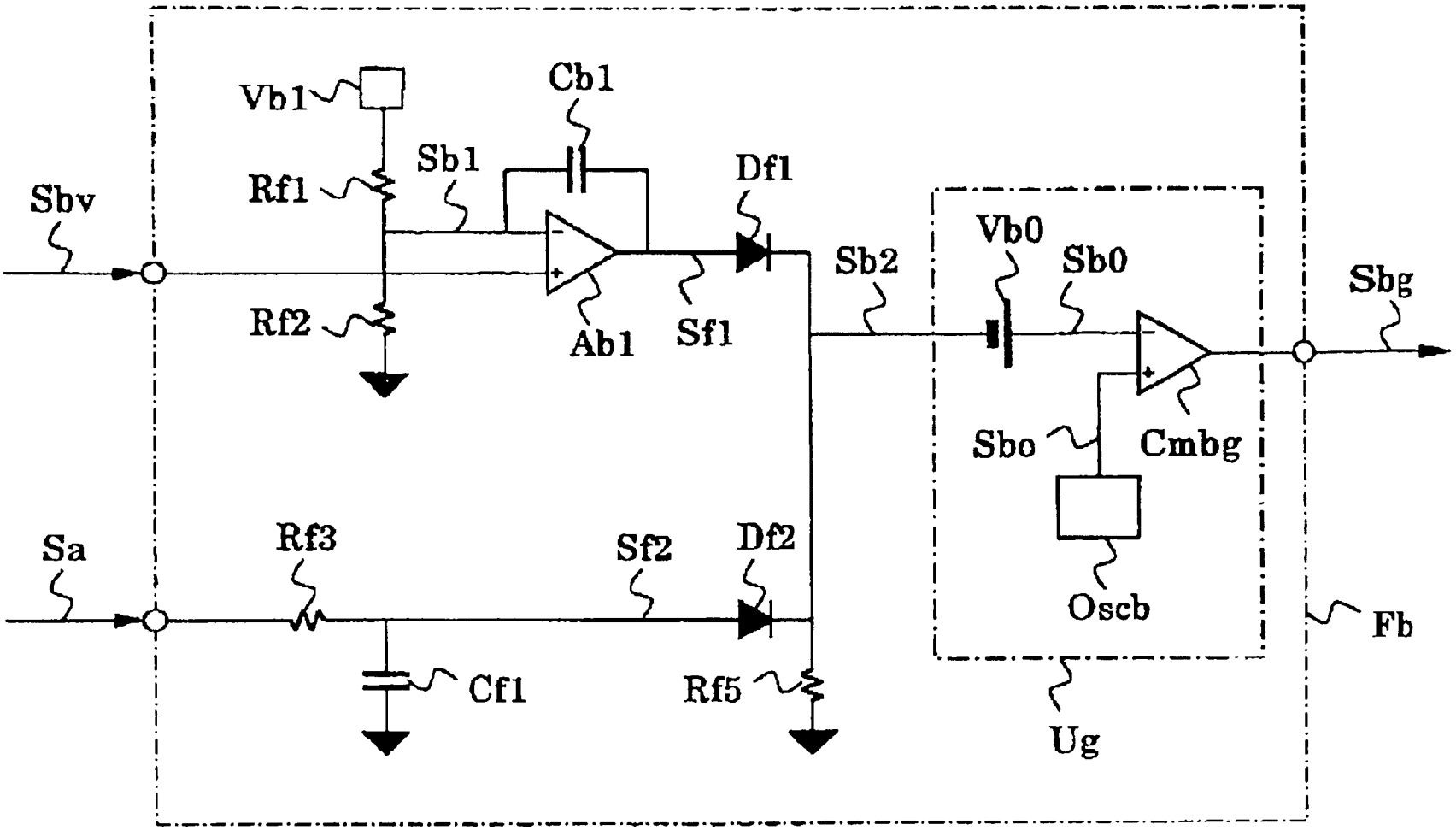
FIG. 10 shows an example of the structure of the voltage conversion circuit (Fb) of the lamp lighting apparatus according to the present invention.

FIG. 10 shows a simplified structure of the voltage conversion controlling circuit (Fb) shown in FIG. 9. The conversion output voltage signal (Sbv) obtained by detection of the output voltage of the voltage conversion circuit (Ub) by the voltage detecting unit (Vb) is inputted to the non-inverting input terminal of the operational amplifier (Ab1). The control target signal (Sb1) corresponding to the target value of the conversion output voltage signal (Sbv) generated by dividing voltage of the appropriate standard voltage source (Vb1) by resistors (Rf1) and (Rf2) is inputted to the inverting input terminal of the operational amplifier (Ab1).

The function of PWM circuit (Ug) comprising the operational amplifier (Ab1), the offset voltage source (Vb0), the comparator (Cmbg), the oscillator (Oscb) is same as that shown in FIG. 6. By the function of diodes (Df1) and (Df2) and the resistor (Rf5), one of the signals (the signal (Sf1) outputted from the operational amplifier (Ab1) and the signal (Sf2) which obtained from the arc discharge transition signal (Sa) outputted from the discharge drive circuit (Ux) and inputted through the resistor (Rf3)), which is not the lower is inputted to the PWM circuit (Ug) as a signal (Sb2).

In the PWM circuit (Ug), since the larger the voltage of the signal (Sb2) the smaller the duty cycle of the gate drive signal (Sbg), by selecting an appropriate circuit constant, when the arc discharge transition signal (Sa) is false logic, that low, the signal (Sf1) is selected, and when the arc discharge transition signal (Sa) is truth logic, that is, high, the signal (Sf2) is selected. In the state in which the signal (Sf2) is selected, it is adapted so that the duty cycle ratio of the gate drive signal (Sbg) becomes zero, that is, the operation of the chopper circuit of the voltage conversion circuit (Ub) is suspended. In the state in which the signal (Sf1) is selected, it is adapted so that the output voltage of the voltage conversion circuit (Ub) becomes the first voltage (Vt1).

Thus, by such a structure, during the period for which the integrated controlling unit (Xpu) maintains the arc discharge transition signal (Sa) as negating logic, by the function of the boost chopper of the voltage conversion circuit (Ub), the output voltage of the voltage conversion circuit (Ub) is maintained at the first voltage (Vt1) at which the discharge drive circuit (Ux) can sufficiently output the unloaded open circuit voltage. After the integrated controlling unit (Xpu) changes the arc discharge transition signal (Sa) from the negating logic to asserting logic, by the suspension of the boost chopper of the voltage conversion circuit (Ub), the output voltage of the voltage conversion circuit (Ub) is supplied from the DC power supply (Em) and maintained at low voltage, that is, the second voltage (Vt2) at which the discharge drive circuit (Ux) can sufficiently output the maximum voltage in the stationary arc discharge thereby controlling the switching loss of the voltage conversion circuit (Ub) to a low level since the voltage is low and eliminating switching loss of the discharge drive circuit (Ux).

Although, in the above description, the lamp lighting apparatus shown in FIG. 3, in which discharge is caused by supplying direct current voltage to the discharge lamp is used as a lamp lighting apparatus for supplying discharge current to the discharge lamp, for example, a lamp lighting apparatus having a full bridge inverter on the output side of the discharge drive circuit (Ux), in which discharge is caused by applying AC voltage to the discharge lamp, works well so as to accomplish the function according to the present invention. Although, in the above description, the lamp lighting apparatus in which a high voltage pulse of the starter (Ui) is applied between the electrodes (E1) and (E2) is used, a starter circuit method, an outside trigger method in which high voltage is applied between one of the electrodes and an outer surface of a discharge space surrounding portion of a lamp case, and other types of starter methods may be used.

Figure 11:
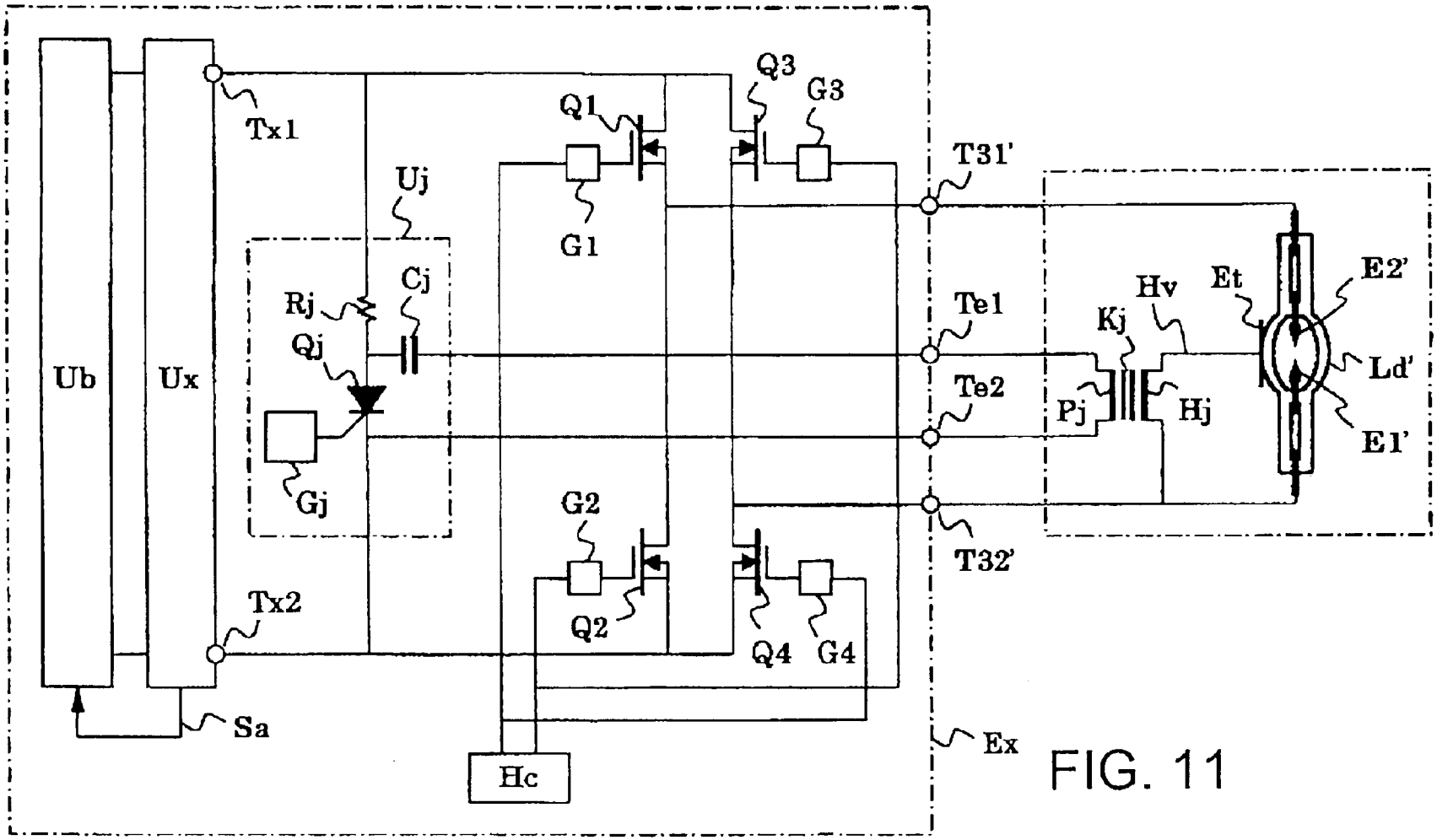
FIG. 11 shows an example of the structure of the lamp lighting apparatus (Ex) according to the present invention.

FIG. 11 shows an example of a lamp lighting apparatus (Ex) using the outside trigger method in which AC voltage is applied to the discharge lamp. In the figure, switching elements (Q1), (Q2), (Q3) and (Q4) such as an FET is added to the circuit shown in FIG. 3 thereby forming full bridge inverter so that alternating discharge voltage is applied to the discharge lamp (Ld').

Each of the switching elements (Q1), (Q2), (Q3) and (Q4) is driven by each gate drive circuit (G1), (G2), (G3), and (G4) respectively. An inverter controlling circuit (Hc) is controlled so that each pair of diagonally facing switching elements (Q1) and (Q4), and (Q2) and (Q3) becomes conductive at the same time.

The function of a starter (Uj) shown in the figure in the outside trigger method, is basically the same as that of the starter (Ui) shown in FIG. 3. That is, a condenser (Cj) is charged through a resistor (Rj) by the lamp voltage (VL) applied during the period for which the unloaded open circuit voltage is generated. When a gate drive circuit (Gj) is activated, a switching element (Qj) comprising a thyristor etc. becomes conductive so that the charges of the condenser (Cj) are discharged through a primary winding (Pj) of a transformer (Kj) thereby generating a high voltage pulse in a secondary winding (Hj).

Since a high voltage terminal (Hv) of the secondary winding (Hj)of the transformer (Kj) is connected to an auxiliary electrode (Et') which is provided on the outside of the discharge container of the discharge lamp (Ld'), the high voltage generated in the high voltage terminal (Hv') causes dielectric barrier discharge between the electrodes (E1') and (E2') of the discharge lamp (Ld) and an inner surface of the discharge container of the discharge lamp (Ld) thereby inducing a main discharge between the electrodes (E1') and (E2').

In this specification, in order to explain the operations, functions and effects of the lamp lighting apparatus according to the present invention, the minimum structure of the circuit is described. Accordingly, it is assumed that originality and ingenuity such as details of the circuit operation, for example, signal polarity, selection, addition and deletion of concrete circuit elements, and changes based on economic reason and convenience of procurement of these elements is actively carried out at actual apparatus design time.

Specifically, a mechanism for protecting the circuit elements such as the switching elements (FET etc.) of the lamp lighting apparatus from factors causing damages such as over current, over voltage, and overheating, a mechanism for reducing radiating noises or conductive noises which are generated along with the operation of the circuit elements of the lamp lighting apparatus, a mechanism for preventing the noises generated from coming out from the apparatus, for example, a snubber circuit, a varistor, a clamped diode, a current limitation circuit (including a puls by-pass type current limitation circuit), a common mode or normal mode noise filter choke coil and a noise filter condenser, may be added to each part of the circuit structure described as embodiments in the specification, if necessary.

Further, although the structure of the lamp lighting apparatus according to the present invention is not limited to the circuit described as the embodiments of the present invention. Specifically, in this specification, a method for controlling lamp power to be constant, which is not based on lamp voltage control, is mainly described, this is not indispensable for the present invention. Therefore, it is possible to use other controlling method in which effects of the present invention is obtained.

In the embodiments, although it is described that determination of transition to arc discharge, and sequence control are carried out by the micro processor (Mpu), a simple controlling circuit instead of the micro processor unit (Mpu) may be used. Thus, a variety of structures of the lamp lighting apparatus may be adapted in order to obtain the effects of the present invention.

In figures, T01, T02, T11, T12, T21, T22, T31, T32 show terminals.

According to the present invention, it is possible to provide a lamp lighting apparatus (Ex) that solves the problem of the prior art, that is, unnecessary power loss caused because after the state of the discharge lamp (Ld) changes to arc discharge, the DC power supply (Em) supplies, to the discharge lamp (Ld), higher voltage than that necessary.

The disclosure of Japanese Patent Application No. 2002-281751 filed on Sep. 26, 2002 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

Further, the present invention possesses a number of advantages or purposes, and there is no requirement that every claim directed to that invention be limited to encompass all of them.

What is claimed is:

1. A lamp lighting apparatus for lighting a discharge lamp in which discharge medium is encapsulated and a pair of electrodes are provided, the lamp lighting apparatus comprising:

a discharge drive circuit that supplies discharge current to the discharge lamp;

a voltage conversion circuit that boosts voltage from a DC power and supplies the boosted voltage to the discharge drive circuit; and an arc discharge detecting circuit that detects whether a state of discharge of the discharge lamp changes to arc discharge, and outputs an arc discharge transition signal to the voltage conversion circuit, wherein when the voltage conversion circuit receives the arc discharge transition signal which shows that the transition to the arc discharge fails to occur, the voltage conversion circuit supplies a first voltage to the discharge drive circuit, and when the voltage conversion circuit receives the arc discharge transition signal which shows that the transition to the arc discharge occurs, the voltage conversion circuit supplies a second voltage lower than the first voltage to the discharge drive circuit.

2. The lamp lighting apparatus according to claim 1, wherein the voltage conversion circuit comprises a boost chopper, and when the voltage conversion circuit receives the arc discharge transition signal which shows that a state of the discharge changes to the arc discharge, an operation of the voltage conversion circuit is suspended.

3. The lamp lighting apparatus according to claim 1, further comprising a starter for initiating the discharge lamp, wherein a predetermined maximum continuing time for repeat trials of discharge initiation is set, and after an arc discharge transition waiting period beginning from an initiation of an operation of the starter expires, the discharge drive circuit recognizes that it is detected that the state of the discharge changes to the arc discharge.

4. The lamp lighting apparatus according to claim 3, wherein the arc discharge transition waiting period is determined by adding the a maximum continuing time and a maximum necessary time required from an initiation of the discharge of the discharge lamp to a completion of the transition of the arc discharge.

5. The lamp lighting apparatus according to claim 2, further comprising a starter for initiating the discharge lamp, wherein a predetermined maximum continuing time for repeat trials of discharge initiation is set, and after an arc discharge transition waiting period beginning from an initiation of an operation of the starter expires, the discharge drive circuit recognizes that it is detected that the state of the discharge changes to the arc discharge.

6. The lamp lighting apparatus according to claim 5, wherein the arc discharge transition waiting period is determined by adding the a maximum continuing time and a maximum necessary time required from an initiation of the discharge of the discharge lamp to a completion of the transition of the arc discharge.

* * * * *